US010464338B2

(12) United States Patent
Hanakawa et al.

(10) Patent No.: US 10,464,338 B2
(45) Date of Patent: Nov. 5, 2019

(54) LIQUID DISCHARGE APPARATUS, CLEANING APPARATUS, AND CLEANING METHOD

(71) Applicant: SEIKO EPSON CORPORATION, Tokyo (JP)

(72) Inventors: Manabu Hanakawa, Matsumoto (JP); Yukimasa Ishida, Shiojiri (JP); Hironori Matsuoka, Shiojiri (JP); Toshio Sukigara, Matsumoto (JP); Kazuhiro Yamato, Shiojiri (JP); Yasunori Kuramoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/730,589

(22) Filed: Oct. 11, 2017

(65) Prior Publication Data

US 2018/0104959 A1 Apr. 19, 2018

(30) Foreign Application Priority Data

Oct. 17, 2016 (JP) ..... 2016-203493
Oct. 17, 2016 (JP) ..... 2016-203494

(51) Int. Cl.

| | |
|---|---|
| ***B41J 2/185*** | (2006.01) |
| ***B41J 2/17*** | (2006.01) |
| ***B41J 2/175*** | (2006.01) |
| ***B41J 2/165*** | (2006.01) |
| ***B41J 2/14*** | (2006.01) |

(52) U.S. Cl.

CPC ..... *B41J 2/185* (2013.01); *B41J 2/14233* (2013.01); *B41J 2/16508* (2013.01); *B41J 2/16523* (2013.01); *B41J 2/175* (2013.01); *B41J 2/1714* (2013.01); *B41J 2/1753* (2013.01); *B41J 2/17523* (2013.01); *B41J 2/17563* (2013.01); *B41J 2/17596* (2013.01); *B41J 2/165* (2013.01); *B41J 2002/16594* (2013.01); *B41J 2002/1856* (2013.01); *B41J 2202/11* (2013.01)

(58) Field of Classification Search

CPC ..... B41J 2/185; B41J 2/16523; B41J 2/1714; B41J 2/17596; B41J 2002/16594; B41J 2002/1856

See application file for complete search history.

(56) References Cited

U.S. PATENT DOCUMENTS

2006/0066698 A1 3/2006 Takatsuka
2008/0136864 A1* 6/2008 Nakamura ..... B41J 2/16523 347/30

FOREIGN PATENT DOCUMENTS

| | | |
|---|---|---|
| JP | 2006-095883 | 4/2006 |
| JP | 2006-264276 | 10/2006 |
| JP | 2007-090585 | 4/2007 |
| JP | 2007-196457 | 8/2007 |
| JP | 2014-193555 | 10/2014 |
| JP | 2016-052720 | 4/2016 |

* cited by examiner

*Primary Examiner* — Geoffrey S Mruk
(74) *Attorney, Agent, or Firm* — Workman Nydegger

(57) ABSTRACT

A liquid discharge apparatus includes a casing, a liquid discharge head that includes a nozzle for discharging a liquid supplied from a liquid supply source provided in the casing, a waste liquid tank that accommodates in the casing a fluid emitted from the nozzle, and an outlet opening for emitting the fluid emitted from the nozzle to an outside of the casing without emitting the fluid into the waste liquid tank provided in the casing.

24 Claims, 5 Drawing Sheets

LIQUID DISCHARGE APPARATUS, CLEANING APPARATUS, AND CLEANING METHOD

BACKGROUND

1. Technical Field

The present invention relates to a technology that cleans a liquid discharge head of a liquid discharge apparatus.

2. Related Art

If, when a liquid discharge head of a liquid discharge apparatus is to be cleaned, it is necessary to perform an operation of detaching the liquid discharge head from the apparatus, then the cleaning of the liquid discharge head will take a long time.

Therefore, as in, for example, JP-A-2014-193555, a technology for reducing the amount of time needed to clean a liquid discharge head of a liquid discharge apparatus by cleaning the liquid discharge head while having the liquid discharge head attached to the liquid discharge apparatus has been developed. In JP-A-2014-193555, after the liquid discharge apparatus is caused to move the liquid discharge head to the home position, a cleaning liquid is supplied to the liquid discharge head. A fluid emitted from the liquid discharge head at this time is emitted into a waste liquid tank that is provided at the home position.

Furthermore, as in, for example, JP-A-2006-95883, a technology for reducing the cleaning time for a liquid discharge head by circulating a cleaning liquid through the liquid discharge head while having the liquid discharge head attached to the liquid discharge apparatus has been developed. In JP-A-2006-95883, ink can also be circulated and a cartridge both for circulating ink and for circulating a cleaning liquid is detachably attached to the liquid discharge apparatus. Concretely, in JP-A-2006-95883, one cartridge has in its interior a circulation flow path for ink (that includes a supply ink chamber, a recovery ink chamber, a flow path that communicates with these chambers, etc.) and a circulation flow path for the cleaning liquid (that includes a cleaning liquid and a flow path that communicates with the cleaning liquid) which are separately provided.

However, in the case where, as in JP-A-2014-193555, a cleaning liquid is supplied to a liquid discharge head and a fluid emitted from the liquid discharge head is emitted into a waste liquid tank, cleaning can be accomplished substantially only as much as the capacity of the waste liquid tank allows. For example, cleaning a liquid discharge head by supplying the cleaning liquid in an amount larger than the capacity of the waste liquid tank cannot be carried out and cleaning by circulating the cleaning liquid cannot be carried out either. An increase of the capacity of the waste liquid tank is conceivable but results in an increased size of the liquid discharge apparatus.

In the case where, as in JP-A-2006-95883, a cartridge both for circulating ink and for circulating a cleaning liquid is detachably attachable to a liquid discharge apparatus, the cartridge has therein a circulation flow path for the ink and a circulation flow path for the cleaning liquid separately from each other and therefore an increased size. Such an increased-size cartridge increase the size of a liquid discharge apparatus to which to attach the cartridge. Furthermore, even when only one of the ink and the cleaning liquid needs to be replaced, the whole cartridge needs to be replaced.

SUMMARY

An advantage of some aspects of the invention is that the cleaning time for a liquid discharge head is reduced, a liquid discharge apparatus is reduced in size, or a cartridge for a cleaning apparatus is reduced in size.

Mode 1

An aspect (Mode 1) of the invention provides a liquid discharge apparatus that includes a casing, a liquid discharge head that includes a nozzle that discharges a liquid supplied from a liquid supply source provided in the casing, and an outlet opening capable of emitting a fluid emitted from the nozzle to an outside of the casing, wherein Condition 1 or Condition 2 mentioned below is satisfied. Condition 1: The liquid discharge apparatus further includes a waste liquid tank that accommodates within the casing the fluid emitted from the nozzle, and the liquid discharge apparatus is capable of emitting the fluid emitted from the nozzle to the outside of the casing from the outlet opening without emitting the fluid emitted from the nozzle into the waste liquid tank within the casing. Condition 2: The liquid discharge apparatus further includes within the casing a pump for moving the fluid emitted from the nozzle, and the liquid discharge apparatus is capable of emitting the fluid emitted from the nozzle to the outside of the casing from the outlet opening without using the pump provided in the casing.

According to the foregoing aspect, since the liquid discharge apparatus includes the outlet opening capable of emitting the fluid emitted from the nozzle to the outside of the casing, the fluid emitted from the nozzle because of the fluid being supplied into the liquid discharge head can be emitted to the outside of the casing from the outlet opening. Therefore, the liquid discharge apparatus can be reduced in size, regardless of the amount of the fluid emitted from the nozzle.

In this case, the fluid to be used may be a cleaning liquid, an ink, air, etc. Therefore, when such a fluid is used for cleaning, the liquid discharge head can be cleaned, regardless of the amount of the fluid emitted from the nozzle. That is, the liquid discharge head can also be vigorously cleaned by using a large amount of a fluid.

Furthermore, since the outlet opening is provided, the fluid emitted from the nozzle can be emitted to the outside of the casing without having to detach the liquid discharge head from the liquid discharge apparatus. For example, when a fluid is used for cleaning, the amount of time required for the cleaning with the fluid can be reduced in comparison with a configuration in which, for the cleaning, the liquid discharge head needs to be detached from the liquid discharge apparatus.

Furthermore, the fluid emitted from the nozzle to the outside of the casing through the outlet opening may be circulated to the liquid discharge head without detaching the liquid discharge head from the liquid discharge apparatus. For example, when a fluid is used for cleaning, the cleaning with the fluid can be efficiently performed in comparison with a configuration in which the fluid is not circulated.

Furthermore, when the liquid discharge apparatus satisfies Condition 1, the fluid emitted from the nozzle can be emitted into the waste liquid tank and therefore accommodated within the casing or can be emitted to the outside of the casing from the outlet opening. Therefore, when the fluid for cleaning is emitted from the nozzle, the fluid may be emitted to the outside of the casing from the outlet opening. That is, the waste liquid tank does not need to be increased in size.

Furthermore, when the liquid discharge apparatus satisfies Condition 2, the fluid emitted from the nozzle can be moved by using the pump provided in the casing or can also be moved without using the pump provided in the casing. Therefore, for example, the fluid may be moved using a pump provided outside the casing (a pump of a cleaning apparatus, or the like) instead of the pump provided in the casing. That is, the pump in the casing does not need to be increased in size.

Mode 2

In an example (Mode 2) according to Mode 1, the liquid discharge apparatus may further include a switching valve that is provided in an intermediate portion of a waste liquid flow path extending from the nozzle to the waste liquid tank and that is capable of communicating with the outlet opening and that switches between a state that causes the fluid emitted from the nozzle to be emitted into the waste liquid tank and a state that causes the fluid emitted from the nozzle to be emitted through the outlet opening. According to this mode, using the switching valve, the fluid emitted from the nozzle can be selectively caused to be emitted to the outside of the casing through the outlet opening without being emitted into the waste liquid tank provided within the casing. This makes it possible to choose either to use the waste liquid tank or not to use the waste liquid tank, so that the service life of the waste liquid tank can be increased. Furthermore, a flow path extending from the nozzle to the switching valve can be used both when the fluid emitted from the nozzle is emitted into the waste liquid tank and when the fluid emitted from the nozzle is emitted through the outlet opening.

Mode 3

In an example (Mode 3) according to Mode 1, the liquid discharge apparatus may further include a waste liquid tank provided in the casing and a switching valve that is provided in an intermediate portion of a waste liquid flow path extending from the nozzle to the waste liquid tank and that is capable of communicating with the outlet opening and that switches between a state that causes the fluid emitted from the nozzle to be emitted into the waste liquid tank and a state that causes the fluid emitted from the nozzle to be emitted through the outlet opening. According to this mode, using the switching valve, the fluid emitted from the nozzle can be selectively caused to be emitted to the outside of the casing through the outlet opening without being emitted into the waste liquid tank within the casing. This makes it possible to choose either to use the waste liquid tank or not to use the waste liquid tank, so that the service life of the waste liquid tank can be increased. Furthermore, a flow path extending from the nozzle to the switching valve can be used both when the fluid emitted from the nozzle is emitted into the waste liquid tank and when the fluid emitted from the nozzle is emitted through the outlet opening.

Mode 4

Another aspect (Mode 4) of the invention provides a liquid discharge apparatus that includes a liquid discharge head that includes a nozzle that discharges a liquid supplied from a liquid supply source, a waste liquid flow path that provides communication between the nozzle and a waste liquid tank, an outlet opening capable of emitting a fluid emitted from the nozzle, and a switching valve that is provided in an intermediate portion of the waste liquid flow path and that is capable of communicating with the outlet opening and that switches between a state that causes the fluid emitted from the nozzle to be emitted into the waste liquid tank and a state that causes the fluid emitted from the nozzle to be emitted through the outlet opening, wherein Condition 1 or Condition 2 mentioned below is satisfied. Condition 1: The liquid discharge apparatus further includes a pump for moving the fluid emitted from the nozzle, and the liquid discharge apparatus is capable of emitting the fluid emitted from the nozzle through the outlet opening without using the pump. Condition 2: The waste liquid tank is capable of accommodating the fluid emitted from the nozzle.

According to this aspect, since the liquid discharge apparatus includes the switching valve that switches between the state that causes the fluid emitted from the nozzle to be emitted into the waste liquid tank and the state that causes the fluid emitted from the nozzle to be emitted to be emitted through the outlet opening, the fluid emitted from the nozzle because of having been supplied into the liquid discharge head can be emitted through the outlet opening instead of into the waste liquid tank. Therefore, the waste liquid tank and the liquid discharge apparatus can be reduced in size.

In this case, the fluid to be used may be a cleaning liquid, an ink, air, etc. Therefore, when such a fluid is used for cleaning, the liquid discharge head can be cleaned, regardless of the size of the waste liquid tank. That is, the liquid discharge head can be vigorously cleaned with a large amount of a fluid.

Furthermore, since the outlet opening is provided, the fluid emitted from the nozzle can be emitted out without having to detach the liquid discharge head from the liquid discharge apparatus. For example, when a fluid is used for cleaning, the amount of time required for the cleaning with the fluid can be reduced in comparison with a configuration in which, for the cleaning, the liquid discharge head needs to be detached from the liquid discharge apparatus.

Furthermore, the fluid emitted from the nozzle and emitted out through the outlet opening may be circulated to the liquid discharge head without detaching the liquid discharge head from the liquid discharge apparatus. For example, when a fluid is used for cleaning, the cleaning with the fluid can be efficiently performed in comparison with a configuration in which the fluid is not circulated.

Furthermore, when the liquid discharge apparatus satisfies Condition 1, the fluid emitted from the nozzle can be moved by using the pump or can be moved without using the pump. Therefore, for example, the fluid may be moved by using a pump of a cleaning apparatus instead of the pump provided in the liquid discharge apparatus. That is, the pump of the liquid discharge apparatus does not need to be increased in size.

Furthermore, when the liquid discharge apparatus satisfies Condition 2, the fluid emitted from the nozzle can be emitted into and accommodated in the waste liquid tank or can be emitted out through the outlet opening. Therefore, when a fluid for cleaning is emitted from the nozzle, the fluid may be emitted out through the outlet opening. That is, the waste liquid tank does not need to be increased in size.

Mode 5

In an example (Mode 5) according to any one of Modes 1 to 4, the liquid discharge apparatus may further include an attaching portion that allows a connecting portion of the liquid supply source for supplying the liquid to the liquid discharge head and a connecting portion for supplying a fluid for cleaning to the liquid discharge head to be interchangeably attached to a single site. According to this mode, since the liquid discharge apparatus includes the attaching portion that allows the connecting portion of the liquid supply source for supplying the liquid to the liquid discharge head and the connecting portion for supplying the fluid for cleaning to the liquid discharge head to be interchangeably attached to the same site on the attaching portion, this attaching portion can be used both for connection with the connecting portion of the liquid supply source and for connection with the connecting portion for supplying the fluid for cleaning. Therefore, the configuration of the attaching portion can be simplified in comparison with the case where the two connecting portions are connected separately to different sites.

Mode 6

In an example (Mode 6) according to any one of Modes 2 to 5, a diameter of an outlet flow path that provides communication between the outlet opening and the switching valve may be larger than at least a diameter of the waste liquid flow path. According to this mode, since the diameter of the outlet flow path that provides communication between the outlet opening and the switching valve is larger than at least the diameter of the waste liquid flow path, large amounts of a fluid, such as a cleaning liquid, can be efficiently emitted through the outlet opening, so that the cleaning of the liquid discharge head can be effectively performed.

Mode 7

In an example (Mode 7) according to any one of Modes 2 to 6, the liquid discharge apparatus may further include a communicator unit that communicates with the liquid supply source wirelessly or by wire and, based on a result of communication of the communicator unit, the switching valve may be switched between a state that causes the fluid emitted from the nozzle to be emitted into the waste liquid tank and a state that causes the fluid emitted from the nozzle to be emitted through the outlet opening. According to this mode, it can be recognized whether the liquid supply source is connected, for example, on the basis of a result of communication of the communicator unit. Therefore, when the liquid supply source is connected (when cleaning is not performed), the switching valve is switched so that the fluid emitted from the nozzle is emitted into the waste liquid tank. Furthermore, when the liquid supply source is not connected (when cleaning is performed), the switching valve is switched so that the fluid emitted from the nozzle is emitted through the outlet opening. Thus, since the switching valve is automatically switched on the liquid discharge apparatus side, incorrect operation of the switching valve initiated by a user can be effectively inhibited in comparison with the case where a user switches the switching valve.

Mode 8

In an example (Mode 8) according to any one of Modes 2 to 7, the switching valve may be capable of being atmospherically opened. According to this mode, by atmospherically opening the switching valve, the fluid remaining in the outlet opening after cleaning can be effectively emitted. This inhibits the flowing down or dripping of the fluid remaining in the outlet opening.

Mode 9

In an example (Mode 9) according to any one of Modes 1 to 8, the liquid discharge apparatus may further include a pump for moving the fluid emitted from the nozzle to the outlet opening. According to this mode, since the liquid discharge apparatus includes the pump for moving the fluid emitted from the nozzle to the outlet opening, the efficiency of moving the fluid emitted from the nozzles N can be increased, so that the liquid discharge head can be more effectively cleaned than in the case where the pump is not used. Furthermore, an existing pump provided in the liquid discharge apparatus (e.g., a pump that is provided for a cap for sealing the nozzle and that sucks the nozzle) can be used as the pump in this mode to clean the liquid discharge head.

Mode 10

In an example (Mode 10) according to any one of Modes 1 to 9, the pump may be operated so as to suck the nozzle and the pump may be operated so that suction force of the pump is greater when the fluid emitted from the nozzle is sucked than when the liquid supplied from the liquid supply source is sucked from the nozzle. According to this mode, since the pump is operated so that the suction force of the pump is greater when the fluid emitted from the nozzle is sucked than when the liquid supplied from the liquid supply source is sucked from the nozzle, the liquid discharge head can be effectively cleaned, for example, even when an existing pump provided in the liquid discharge apparatus is used to clean the liquid discharge head.

Mode 11

In an example (Mode 11) according to any one of Modes 1 to 10, the liquid discharge apparatus may further include a cover that covers the outlet opening. According to this mode, since the outlet opening is covered with the cover, entrance of dust into the outlet opening can be prevented.

Mode 12

Still another aspect (Mode 12) of the invention provides a cleaning apparatus that cleans the liquid discharge head of the liquid discharge apparatus according to any one of Modes 1 to 11, the cleaning apparatus including a supply flow path that supplies a fluid for cleaning to the liquid discharge head attached to the liquid discharge apparatus, and a recovery flow path for recovering the fluid emitted from the outlet opening. According to this aspect, because the fluid for cleaning is supplied from the supply flow path of the cleaning apparatus to the liquid discharge head, the fluid emitted from the nozzle is emitted through the outlet opening, so that the fluid can be recovered through the recovery flow path of the cleaning apparatus. Therefore, without a need to detach the liquid discharge head from the liquid discharge apparatus nor a need to use the waste liquid tank, it is possible to vigorously clean the liquid discharge head with a large amount of the fluid for use for cleaning and, furthermore, efficiently clean the liquid discharge head by circulating the fluid for use for cleaning. Therefore, in comparison with the case where the liquid discharge head is detached from the liquid discharge apparatus before being cleaned, the cleaning time for the liquid discharge head can be shortened and, furthermore, the vigorous cleaning of the liquid discharge head is possible without having to increase the size of the waste liquid tank provided in the casing, so that the liquid discharge apparatus itself can be reduced in size. Thus, this mode of the invention reduces the cleaning time for the liquid discharge head and also allows size reduction of the liquid discharge apparatus.

Mode 13

In an example (Mode 13) according to Mode 12, the cleaning apparatus may further include a connecting portion for connecting the supply flow path to the liquid discharge head, and the connecting portion may be capable of being attached, interchangeably with a connecting portion of the liquid supply source, to an attaching portion provided in the liquid discharge apparatus to which the connecting portion of the liquid supply source is attached so as to be connected to the liquid discharge head, at the same site in the attaching portion as the connecting portion of the liquid supply source is attached. According to this mode, since the connecting portion of the supply flow path can be attached, interchangeably with the connecting portion of the liquid supply source, to the attaching portion of the liquid discharge apparatus, at the same site on the attaching portion as the connecting portion of the liquid supply source is attached, the configuration of the attaching portion can be simplified in comparison with the case where the two connecting portions are connected separately to different sites.

Mode 14

In an example (Mode 14) according to Mode 13, the cleaning apparatus may further include a pump that is provided in an intermediate portion of the recovery flow path and that is configured to move the fluid emitted from the nozzle toward the recovery flow path via the outlet opening. According to this mode, the pump of the cleaning apparatus can move the fluid emitted from the nozzle of the liquid discharge head toward the recovery flow path via the outlet opening, not by applying positive pressure but by suction. Therefore, undesirable substances, bubbles, etc. in the liquid discharge head can be effectively emitted.

Mode 15

In an example (Mode 15) according to any one of Modes 12 to 14, the cleaning apparatus may further include a circulation flow path for moving the fluid from the recovery flow path to the supply flow path. According to this mode, because the fluid recovered via the recovery flow path can be returned to the supply flow path via the circulation flow path, the fluid can be re-supplied to the liquid discharge head. This makes it possible to perform the circulatory cleaning in which the liquid for cleaning is circulated through the liquid discharge head, so that the liquid discharge head can be effectively cleaned without using a large amount of the liquid.

Mode 16

In an example (Mode 16) according to any one of Modes 12 to 15, the cleaning apparatus may further include, as tanks for storing the fluid, at least a first tank provided on the circulation flow path and a second tank provided on the supply flow path. According to this mode, since the cleaning apparatus includes at least the first tank provided on the circulation flow path and the second tank provided on the supply flow path, it is possible to use the first tank for circulatory cleaning and the second tank for non-circulatory cleaning. Furthermore, by storing different kinds of fluids for cleaning in the first tank and the second tank, circulatory cleaning and non-circulatory cleaning can use the different kinds of fluids for cleaning. Furthermore, it is possible to adopt an arrangement in which the second tank for use for non-circulatory cleaning is not heated and the first tank for use for circulatory cleaning is heated. This can increase the cleaning effect of circulatory cleaning.

Mode 17

In an example (Mode 17) according to any one of Modes 12 to 16, the cleaning apparatus may further include a filter provided in an intermediate portion of the supply flow path. According to this mode, the filter can remove undesired substances from the fluid that flows through the supply flow path. Therefore, for example, during the circulatory cleaning of the liquid discharge head, the fluid from which undesirable substances are removed by the filter can be returned to the liquid discharge head through the supply flow path. This will reduce the burden that cleaning causes on the filter in the liquid discharge apparatus and therefore can increase the service life of the filter provided in the liquid discharge apparatus.

Mode 18

In an example (Mode 18) according to any one of Modes 12 to 17, the cleaning apparatus may further include an atmospherically openable valve provided in an intermediate portion of the supply flow path and capable of being switched to be atmospherically open. According to this mode, when the atmospherically openable valve is atmospherically opened, the fluid remaining in the supply flow path after cleaning can also be efficiently emitted. This, for example, inhibits the flowing down or dripping of the fluid remaining in the supply flow path when a connecting portion that communicates with the supply flow path is detached from the attaching portion of the liquid discharge head.

Mode 19

In an example (Mode 19) according to any one of Modes 12 to 18, the cleaning apparatus may further include an open/close valve provided in an intermediate portion of the supply flow path. According to this mode, by closing the open/close valve, the flowing down or dripping of the fluid remaining in the supply flow path can be inhibited.

Mode 20

In an example (Mode 20) according to any one of Modes 12 to 19, the cleaning apparatus may further include a negative pressure generating mechanism provided in an intermediate portion of the supply flow path. According to this mode, by producing negative pressure in the supply flow path by using the negative pressure generating mechanism, the flowing down or dripping of the fluid remaining in the supply flow path can be inhibited.

Mode 21

Yet another aspect (Mode 21) of the invention provides a cleaning method for the liquid discharge head in the liquid discharge apparatus according to any one of Modes 1 to 20, the cleaning method including a first step of emitting a fluid from the nozzle of the liquid discharge head by supplying a fluid for cleaning to the liquid discharge head attached to the liquid discharge apparatus and a second step of recovering the fluid emitted from the nozzle via the outlet opening of the liquid discharge apparatus. According to this aspect, by performing the first step of emitting a fluid from the nozzle of the liquid discharge head by supplying a fluid for cleaning to the liquid discharge head attached to the liquid discharge apparatus and the second step of recovering the fluid emitted from the nozzle via the outlet opening of the liquid discharge apparatus, the liquid discharge head can be cleaned while the liquid discharge head is attached to the liquid discharge apparatus. Therefore, the cleaning time needed for the liquid discharge head can be reduced in comparison with the case where the liquid discharge head is detached from the liquid discharge apparatus before being cleaned. Furthermore, because the liquid discharge head can be cleaned without having to use the waste liquid tank provided in the liquid discharge apparatus, vigorous cleaning is possible without having to increase the size of the waste liquid tank provided in the liquid discharge apparatus. Therefore, the liquid discharge apparatus itself can be reduced in size. Thus, according to this aspect, it is possible to reduce the cleaning time needed for the liquid discharge head and, at the same time, reduce the size of the liquid discharge apparatus.

Mode 22

In an example (Mode 22) according to Mode 21, the cleaning method may further include a third step of supplying the fluid recovered in the second step to the liquid discharge apparatus and emitting a fluid from the nozzle of the liquid discharge head. According to this mode, by performing the third step of supplying the fluid recovered in the second step to the liquid discharge apparatus and emitting a fluid from the nozzle of the liquid discharge head, cleaning (circulatory cleaning) in which a fluid for cleaning is circulated to the liquid discharge head can be carried out while the liquid discharge head is attached to the liquid discharge apparatus.

Mode 23

In an example (Mode 23) according to Mode 21 or Mode 22, after the liquid discharge head is cleaned, a fluid in the outlet opening of the liquid discharge apparatus may be emitted by using air. According to this mode, since the cleaning of the liquid discharge head is followed by the emission of a fluid from the outlet opening caused by air, the flowing down or dripping of the fluid remaining in the outlet opening can be inhibited.

Mode 24

In an example (Mode 26) according to any one of Modes 21 to 23, a cleaning history of the liquid discharge head may be stored in a storage unit and, based on the cleaning history, subsequent cleaning of the liquid discharge head may be performed. According to this mode, since the cleaning history of the liquid discharge head is stored in the storage unit and the subsequent cleaning of the liquid discharge head is performed on the basis of the cleaning history, the subsequent cleaning of the liquid discharge head can be performed, for example, for an increased cleaning time, when the cleaning of the liquid discharge head performed up to the previous cleaning operation is not sufficient.

Mode 25

In an example (Mode 25) according to Mode 22, the cleaning method may further include employing a cleaning apparatus that includes a supply flow path that supplies the fluid for cleaning to the liquid discharge head, a recovery flow path for recovering the fluid emitted from the outlet opening, a circulation flow path for moving the fluid from the recovery flow path to the supply flow path, and, as tanks for storing the fluid, at least a first tank provided on the circulation flow path and a second tank provided on the supply flow path, a circulatory cleaning step of cleaning the liquid discharge head by circulating the fluid stored in the first tank to the liquid discharge head by the first step, the second step, and the third step, and a non-circulatory cleaning step of cleaning the liquid discharge head with the fluid stored in the second tank by the first step and the second step, without circulating the fluid to the liquid discharge head. According to this mode, the fluid for use in the circulatory cleaning step and the fluid for use in the non-circulatory cleaning step can be separate from each other. When the first tank and the second tank store different kinds of fluids, the circulatory cleaning step and the non-circulatory cleaning step can use mutually different kinds of liquids for cleaning.

Mode 26

In an example (Mode 26) according to Mode 25, the non-circulatory cleaning step may be performed after the circulatory cleaning step. According to this mode, it is possible to first perform the non-circulatory cleaning step of cleaning the liquid discharge head by passing the fluid from the second tank through the liquid discharge head and then perform the circulatory cleaning step of cleaning the liquid discharge head by circulating the fluid from the first tank to the liquid discharge head. Therefore, because stain or the like can be removed from interiors of the liquid discharge head in the non-circulatory cleaning step before the circulatory cleaning step is performed, the cleaning effect of the circulatory cleaning can be improved. Furthermore, it is possible to heat only the fluid stored in the first tank which is for use for the circulatory cleaning, so that heat used for the heating can be used for the cleaning without wasting the heat.

Mode 27

In an example (Mode 27) according to Mode 25, the non-circulatory cleaning step may be performed after the circulatory cleaning step. According to this mode, it is possible to first perform the circulatory cleaning step of cleaning the liquid discharge head by circulating the fluid from the first tank through the liquid discharge head and then perform the non-circulatory cleaning step of cleaning the liquid discharge head by passing the fluid from the second tank through the liquid discharge head. Therefore, in the non-circulatory cleaning step, a fluid different from the fluid used in circulatory cleaning can be passed through the liquid discharge head. Hence, it is possible, for example, to use a fluid having high cleaning effect in circulatory cleaning and a fluid high in filling capability (wetting property) in non-circulatory cleaning, so that it is possible to increase the cleaning effect of circulatory cleaning and, at the same time, increase the ink filling capability exhibited after non-circulatory cleaning.

Mode 28

A cleaning apparatus according to a mode (Mode 28) of the invention is a cleaning apparatus that cleans a liquid discharge head of a liquid discharge apparatus and includes a supply flow path that supplies a fluid for cleaning to a liquid discharge head, a recovery flow path for recovering from an outlet opening of the liquid discharge apparatus a fluid emitted from the liquid discharge head, and a circulation flow path for moving the fluid from the recovery flow path to the supply flow path, the circulation flow path extending via an internal flow path of a detachable cartridge that stores a fluid. According to this mode, since the fluid emitted from the liquid discharge head is recovered from the outlet opening of the liquid discharge apparatus, the liquid discharge head can be cleaned without having to detach the liquid discharge head from the liquid discharge apparatus. Furthermore, the fluid recovered from the liquid discharge head via the recovery flow path can be returned via the circulation flow path to the supply flow path and therefore to the liquid discharge head so as to perform circulatory cleaning. Furthermore, the cartridge in this mode includes the internal flow path that forms a portion of the circulation flow path and is not provided with a circulation flow path for ink. Therefore, the cartridge can be reduced in size compared with a cartridge that, for example, has not only a circulation flow path for a cleaning liquid but also a circulation flow path for ink. Furthermore, since the cleaning apparatus and the liquid discharge apparatus are separate from each other, the liquid discharge apparatus can be reduced in size compared with a liquid discharge apparatus in which a cartridge for ink and a cartridge for a cleaning liquid are attached.

Mode 29

In an example (Mode 29) according to Mode 28, the cleaning apparatus may further include a communicator unit that communicates with the liquid discharge apparatus wirelessly or by wire. According to this mode, since the cleaning apparatus includes the communicator unit that communicates with the liquid discharge apparatus wirelessly or by wire, the cleaning apparatus, using the communicator unit, can exchange various kinds of information with the liquid discharge apparatus.

Mode 30

In an example (Mode 30) according to Mode 29, the information sent to the liquid discharge apparatus by the communicator unit may include information that is to be displayed by a display unit that is provided on the liquid discharge apparatus. According to this mode, since the information sent to the liquid discharge apparatus by the communicator unit includes information that is to be displayed by a display unit that is provided on the liquid discharge apparatus, the need to provide a display unit on the cleaning apparatus side is eliminated and the number of component parts can be reduced.

Mode 31

In an example (Mode 31) according to Mode 29 or Mode 30, the cleaning apparatus may further include a remaining amount detector unit that detects the amount of the fluid remaining in the cartridge and the information sent to the liquid discharge apparatus by the communicator unit may include information on the remaining amount of the fluid detected by the remaining amount detector unit. According to this mode, since the information sent to the liquid discharge apparatus by the communicator unit includes information on the remaining amount of the fluid detected by the remaining amount detector unit, the cleaning apparatus can be operated according to the amount of the fluid remaining in the cartridge. For example, according to the amount of the fluid remaining in the cartridge, a user can be prompted to replace the cartridge or a cleaning operation can be interrupted.

Mode 32

In an example (Mode 32) according to any one of Modes 29 to 32, the information sent to the liquid discharge apparatus by the communicator unit may include information on the progress of the cleaning of the liquid discharge head. According to this mode, since the information sent to the liquid discharge apparatus by the communicator unit includes information on the progress of the cleaning of the liquid discharge head, the cleaning apparatus can perform an operation according to the progress of the cleaning. For example, when an abnormality occurs such that the cleaning operation is interrupted partway through, the then status of progress can be stored, so that, after the abnormality is removed, the cleaning operation can be restarted immediately following the point of interruption.

Mode 33

In an example (Mode 33) according to any one of Modes 28 to 32, the cleaning apparatus may further include an abnormality detector unit that detects abnormality and the information sent to the liquid discharge apparatus by the communicator unit may include information detected by the abnormality detector unit. According to this mode, since the information sent to the liquid discharge apparatus by the communicator unit includes information detected by the abnormality detector unit, an operation according to the detected information can be performed. For example, when a liquid leak, overheating, overload of a motor, etc., is detected, such an abnormality can be notified to a user or a cleaning operation can be interrupted.

Mode 34

In an example (Mode 34) according to any one of Modes 28 to 33, the cleaning apparatus may further include an electric power supply unit that is supplied with electric power from the liquid discharge apparatus. According to this mode, the electric power supply unit can supply electric power from the liquid discharge apparatus to various portions of the cleaning apparatus. This configuration eliminates the need to provide an electric power supply on the cleaning apparatus side and thus allows the cleaning apparatus to be reduced in size.

Mode 35

In an example (Mode 35) according to any one of Modes 28 to 34, the cartridge may include an electric power supply terminal that is supplied with electric power. According to this mode, since the cartridge includes the electric power supply terminal that is supplied with electric power, it is no longer necessary to provide on the cartridge side an electric power supply that supplies electric power to a component part (a heater or the liker) that needs electric power, when the cleaning apparatus includes such a component part, and therefore it becomes possible to reduce the cartridge in size.

Mode 36

In an example (Mode 36) according to any one of Modes 28 to 35, the cleaning apparatus may further include a waste liquid tank that accommodates a fluid and a switching valve that is provided between the recovery flow path and the circulation flow path and that switches between a state that provides communication between the recovery flow path and the waste liquid tank and a state that provides communication between the recovery flow path and the circulation flow path. According to this mode, when the switching valve provides communication between the recovery flow path and the waste liquid tank, the fluid in the circulation flow path can be emitted into the waste liquid tank. Furthermore, according to this mode, for example, it is possible to first cause the switching valve to provide communication between the recovery flow path and the waste liquid tank and emit fluid from the circulation flow path into the waste liquid tank and then cause the switching valve to provide communication between the recovery flow path and the circulation flow path and restart circulatory cleaning with a fresh cleaning liquid. Thus, cleaning with a fresh cleaning liquid can be performed midway through circulatory cleaning.

Mode 37

In an example (Mode 37) according to any one of Modes 28 to 36, the cleaning apparatus may further include, besides the aforementioned cartridge, which is termed herein the first cartridge, a second cartridge that is separate from the first cartridge and that stores a fluid, the first cartridge being detachably attachable to the circulation flow path and the second cartridge being detachably attachable to the supply flow path or the circulation flow path. According to this mode, cleaning with the fluid from the first cartridge and cleaning with the fluid from the second cartridge can be performed. For example, the fluid stored in the first cartridge and the fluid stored in the second cartridge may have different cleaning characteristics. Furthermore, one of the fluids stored in the first cartridge and the second cartridge may be a fluid mainly for cleaning the liquid discharge head and the other may be a fluid mainly for increasing the ink filling capability of the liquid discharge head.

Mode 38

In an example (Mode 38) according to any one of Modes 28 to 37, the cleaning apparatus may further include a connecting portion for connecting the supply flow path to the liquid discharge head, and the connecting portion for connecting the supply flow path to the liquid discharge head may be capable of being attached, interchangeably with a connecting portion of a liquid supply source, to an attaching portion provided in the liquid discharge apparatus to which the connecting portion of the liquid supply source is attached so as to be connected to the liquid discharge head, at the same site in the attaching portion as the connecting portion of the liquid supply source is attached. According to this mode, since the connecting portion for connecting the supply flow path to the liquid discharge head is capable of being attached, interchangeably with a connecting portion of a liquid supply source, to an attaching portion provided in the liquid discharge apparatus to which the connecting portion of the liquid supply source is attached so as to be connected to the liquid discharge head, at the same site in the attaching portion as the connecting portion of the liquid supply source is attached, a mechanism of the cleaning apparatus for connecting the supply flow path can be simplified.

Mode 39

A cartridge according to a mode (Mode 39) is a cartridge provided for the cleaning apparatus according to any one of Modes 28 to 38 and includes a supply opening through which a fluid is supplied to the supply flow path, a recovery opening through which a fluid from the recovery flow path is recovered, and a storage chamber that communicates with the supply opening and the recovery opening and forms an internal flow path and that stores a fluid. According to this mode, since the cartridge includes the supply opening through which the fluid is supplied to the supply flow path, the recovery opening through which the fluid from the recovery flow path is recovered, and the storage chamber that communicates with the supply opening and the recovery opening and forms the internal flow path and that stores the fluid, the cartridge can be easily attached to flow paths of the cleaning apparatus via the supply opening and the recovery opening.

Mode 40

In an example (Mode 40) according to Mode 39, the cartridge may further include a filter between the supply opening and the recovery opening. According to this mode, the filter can remove undesirable substances contained in the fluid that is supplied from the supply opening to the supply flow path. Therefore, for example, even when the fluid recovered through the recovery opening is contaminated with undesirable substances during the circulatory cleaning of the liquid discharge head, the fluid from which the undesirable substances are removed by the filter can be returned to the liquid discharge head through the supply flow path.

Mode 41

In an example (Mode 41) according to Mode 39 or Mode 40, the cartridge may further include a temperature adjuster unit that adjusts the temperature of the fluid stored in the storage chamber. According to this mode, the temperature adjuster unit may raise or may also lower the temperature of the fluid, such as a liquid, in the storage chamber. The temperature of the fluid can be set to a temperature that is suitable for the cleaning of the liquid discharge head or for the ink filling capability. For example, the temperature of the fluid, such as a liquid, in the storage chamber is raised to a predetermined temperature that is higher than normal temperature. This can increase the effect of the circulatory cleaning with the fluid from the cartridge.

Mode 42

In an example (Mode 42) according to Mode 41, the cartridge may further include a surrounding portion that surrounds the storage chamber so that a space is formed between the storage chamber and the surrounding portion, the space may be filled with a heating medium, and the temperature adjuster unit may adjust the temperature of the fluid in the storage chamber by adjusting the temperature of the heating medium. According to this mode, since the temperature of the fluid in the storage chamber is adjusted by adjusting the temperature of the heating medium, the temperature of the fluid in the storage chamber can be indirectly adjusted from outside the storage chamber, by using the heating medium.

Mode 43

In an example (Mode 43) according to Mode 39 or Mode 42, the cartridge may further include an electric power supply terminal that is supplied with electric power and that is disposed on the same surface as the supply opening and the recovery opening are disposed. According to this mode, since the electric power supply terminal supplied with electric power is disposed on the same surface as the supply opening and the recovery opening are disposed, attachment to and detachment from the electric power supply terminal can be easily carried out and contact between the cartridge-side electric power supply terminal and the cleaning apparatus-side terminal can be enhanced.

Mode 44

In an example (Mode 44) according to any one of Modes 39 to 43, the storage chamber of the cartridge may be at least partially formed by a transparent member. According to this mode, since the storage chamber is at least partially formed by a transparent member, an interior of the storage chamber can be seen and therefore the amount or color of the fluid in the storage chamber can be visually recognized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
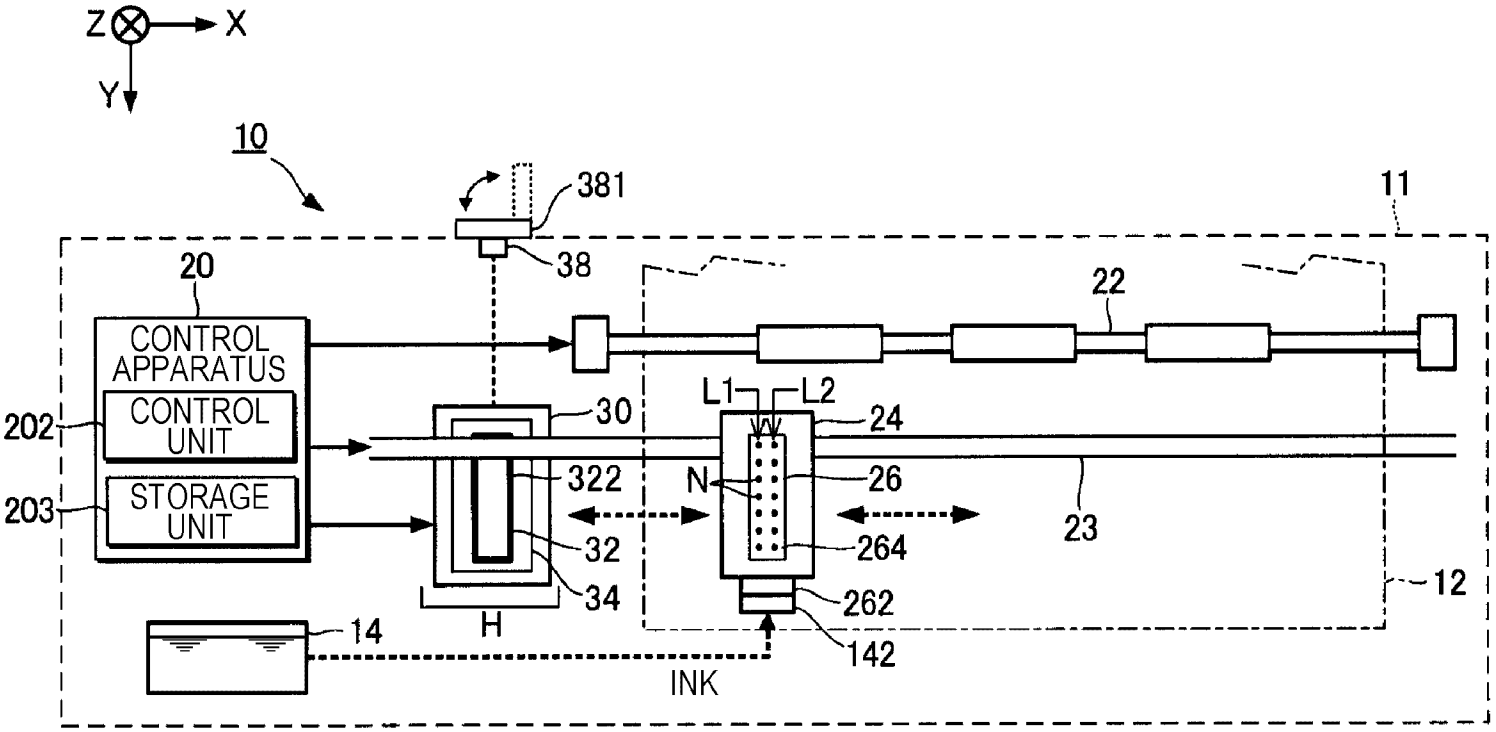
FIG. 1 is a configuration diagram of a liquid discharge apparatus according to an exemplary embodiment of the invention.

FIG. 1 is a partial configuration diagram of a liquid discharge apparatus 10 according to an exemplary embodiment of the invention. The liquid discharge apparatus 10 in this exemplary embodiment is an ink jet type printing apparatus that discharges ink, an example of a liquid, to a medium 12 such as a sheet of paper for printing. The liquid discharge apparatus 10 illustrated in FIG. 1 includes a casing 11. The casing 11 typically has a generally rectangular parallelepiped shape. However, the shape of the casing 11 is not limited to a rectangular parallelepiped shape. Within the casing 11 there are provided a control apparatus 20, a transporting mechanism 22, a moving mechanism 23, a carriage 24, a liquid discharge head 26, a liquid supply source 14, and a maintenance unit 30. Although FIG. 1 shows an example in which one liquid discharge head 26 is mounted on the carriage 24, this arrangement does not limit the invention but a plurality of liquid discharge heads 26 may be mounted on the carriage 24.

The liquid supply source 14 is an ink tank type cartridge made up of a box-shaped container that is detachably attached to a main body of the liquid discharge apparatus 10. The liquid supply source 14 is not limited to a box-shaped container but may also be an ink pack type cartridge made up of a bag-shaped container. The liquid supply source 14 stores ink. The ink may be a black ink or may also be a color ink. The ink stored in the liquid supply source 14 is pumped to the liquid discharge head 26 by a pump (not depicted). The liquid supply source 14 includes a connecting portion 142 for communicating with the liquid discharge head 26. The connecting portion 142 is freely detachably attached to an attaching portion 262 provided on the liquid discharge head 26. Concretely, the connecting portion 142 is a connector having a hole for communicating with an ink supply needle or an ink supply hole of the attaching portion 262.

The control apparatus 20 includes a control unit 202, for example, a central processing unit (CPU), a field programmable gate array (FPGA), etc., and a storage unit 203, such as a semiconductor memory. The control apparatus 20 performs overall control of various components and elements of the liquid discharge apparatus 10 by the control unit 202 executing control programs stored in the storage unit 203. Print data that represent images to be formed on a medium 12 are supplied to the control apparatus 20 from an external apparatus (not depicted) such as a host computer. The control apparatus 20 controls various components and elements of the liquid discharge apparatus 10 so that an image designated by print data is formed on the medium 12.

The transporting mechanism 22 transports the medium 12 in a Y direction (subsidiary scanning direction) under control of the control apparatus 20. The moving mechanism 23 moves the carriage 24 back and forth along an X direction (main scanning direction) under control of the control apparatus 20. Incidentally, the configurations of the transporting mechanism 22 and the moving mechanism 23 are not limited to what are mentioned above as examples. The liquid discharge head 26 mounted on the substantially box-shaped carriage 24 discharges the ink supplied from the liquid supply source 14 to the medium 12 under control of the control apparatus 20. The control apparatus 20 moves the carriage 24 back and forth along the X direction, which intersects the Y direction. As the transporting mechanism 22 transports the medium 12 and the carriage 24 repetitively moves back and forth, the liquid discharge head 26 discharges the ink to the medium 12, so that a desired image is formed on a surface of the medium 12. Note that the liquid supply source 14 may be mounted, together with the liquid discharge head 26, on the carriage 24.

A discharge surface of the liquid discharge head 26 (a surface thereof that faces the medium 12) illustrated in FIG. 1 is provided with two rows L1 and L2 of nozzles. Each of the nozzle rows L1 and L2 is a set of a plurality of nozzles N arranged linearly along the Y direction. The nozzles N of the nozzle rows L1 and L2 discharge the ink supplied from the liquid supply source 14. Incidentally, the ink supplied to the nozzle row L1 and the ink supplied to the nozzle row L2 may be one and the same color ink or different color inks. Furthermore, the configuration of the nozzles N is not limited to the configuration mentioned above as an example; for example, three or more rows of nozzles may be disposed in the discharge surface of the liquid discharge head 26 and each nozzle row may be made up of more than one line of nozzles (e.g., disposed in a zigzag or staggered arrangement).

The liquid discharge head 26 includes a liquid discharge unit 264. The liquid discharge unit 264 discharges the ink supplied from the liquid supply source 14 to the medium 12 through the plurality of nozzles N. The liquid discharge unit 264 includes a plurality of discharger portions 266 that correspond one-to-one to different nozzles N. Each discharger portion is supplied with the ink from the liquid supply source 14. Each discharger portion 266 is supplied, from the control unit 202, with a drive signal (drive pulse) based on the print data. The discharger portions 266, according to drive signals, discharge the ink from the nozzles N.

Figure 2:
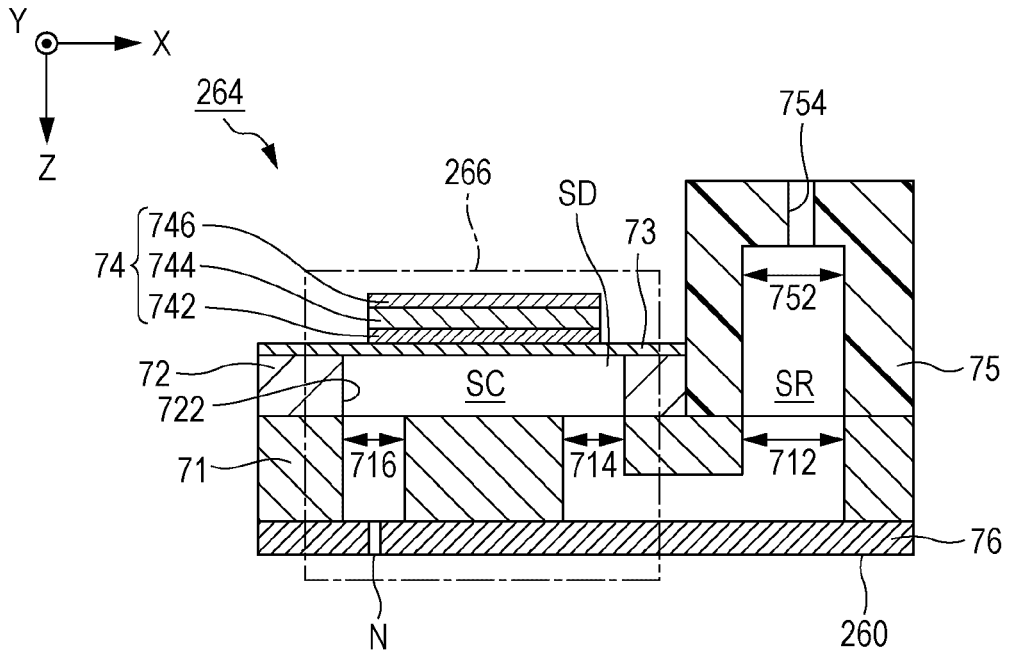
FIG. 2 is a sectional view of a liquid discharge unit.

FIG. 2 is a sectional view of the liquid discharge unit 264, focusing on a given one of the discharger portions 266. The liquid discharge unit 264 illustrated in FIG. 2 is a structural body in which one surface side of a flow path substrate 71 is provided with a pressure chamber substrate 72, a vibration plate 73, a piezoelectric element 74, and a support body 75 and the opposite surface of the flow path substrate 71 is provided with a nozzle plate 76. The flow path substrate 71, the pressure chamber substrate 72, and the nozzle plate 76 are form, for example, from flat platy members made of silicon. The support body 75 is formed, for example, by injection molding of a resin material. The nozzles N are form in the nozzle plate 76. In the configuration illustrated in FIG. 2, a surface of the nozzle plate 76 which faces the medium 12 forms the discharge surface 260 of the liquid discharge head 26.

The flow path substrate 71 is provided with an opening portion 712, branch flow paths (construction flow paths) 714, and a communication flow path 716. The branch flow paths 714 and the communication flow paths 716 form through holes that are provided separately for each nozzle N. The opening portion 712 is an opening continuously formed so as to communicate with the plurality of nozzles N. A space formed by an accommodating portion (recess portion) 752 formed in the support body 75 and the opening portion 712 formed in the flow path substrate 71 which communicate with each other functions as a common liquid chamber (reservoir) SR that stores the ink supplied from the liquid supply source 14 through an introduction flow path 754 formed in the support body 75.

The pressure chamber substrate 72 is provided with opening portions 722 that are formed separately for each nozzle N. The vibration plate 73 is an elastically deformable flat platy member disposed on an opposite side surface of the pressure chamber substrate 72 to the flow path substrate 71. A space inside each opening portion 722 of the pressure chamber substrate 72 which is sandwiched between the vibration plate 73 and the flow path substrate 71 functions as a pressure chamber (cavity) SC that is filled with the ink supplied from the common liquid chamber SR through the branch flow path 714. Each pressure chamber SC communicates with a corresponding one of the nozzles N through a corresponding one of the communication flow paths 716 formed in the flow path substrate 71. The pressure chambers SC, the common liquid chamber SR, the opening portion 712 and the branch flow paths 714 that provide communication between the pressure chambers SC and the common liquid chamber SR, and the communication flow paths 716 form a space that forms an internal space SD of the liquid discharge head 26.

The opposite side surface of the vibration plate 73 to the pressure chamber substrate 72 is provided with piezoelectric elements 74 formed separately for each nozzles N. Each piezoelectric element 74 is a driving element in which a piezoelectric body 744 is interposed between a first electrode 742 and a second electrode 746. One of the first electrode 742 and the second electrode 746 is supplied with a drive signal and the other one is supplied with a predetermined reference electric potential. When supplied with a drive signal, a piezoelectric element 74 deforms to vibrate the vibration plate 73 so that the pressure in the corresponding pressure chamber SC changes, discharging the ink from the pressure chamber SC through the nozzle N. Concretely, an discharge amount of the ink corresponding to an amplitude of the drive signal is discharged from the nozzle N. The discharger portion 266 shown as an example in FIG. 2 is a portion that includes a piezoelectric element 74, a vibration plate 73, a pressure chamber SC, and the nozzles N. The configuration of the piezoelectric elements 74 is not limited to what is mentioned above.

The maintenance unit 30 illustrated in FIG. 1 is disposed, for example, in a non-printing region H that includes a home position (standby position) of the carriage 24 in the X direction. The maintenance unit 30 performs maintenance of the liquid discharge head 26 when the carriage 24 is in the non-printing region H. The maintenance unit 30 includes a capping mechanism 32 that is controlled by the control unit 202 and a waste liquid tank 34 that accommodates fluid (a cleaning liquid, the ink, etc.) emitted from the nozzles N. Inside the waste liquid tank 34 there is provided, for example, an absorber material that holds the ink, the cleaning liquid, etc.

The capping mechanism 32 is used to cap the discharge surface 260 of the liquid discharge head 26. The capping mechanism 32 includes a cap 322 that seals the nozzles N of the discharge surface 260. The cap 322 has a box shape whose side facing in a negative Z direction has an opening. An opening edge portion of the cap 322 comes into contact with the discharge surface 260 to seal the nozzles N of the discharge surface 260. The cap 322 can be moved by a motor (not depicted) in the negative Z direction in which the cap 322 moves to contact the discharge surface 260 or a positive Z direction in which the cap 322 moves away from the discharge surface 260. The control apparatus 20 seals the nozzles N by causing the cap 322 to contact the discharge surface 260. At this time, bubbles or the ink with increased viscosity can be sucked and emitted from the nozzles N into the cap 322 by using a pump 35 (described later) illustrated in FIG. 3. The ink emitted into the cap 322 is discarded into the waste liquid tank 34 through a waste liquid flow path 33 (described later) illustrated in FIG. 3.

The liquid discharge head 26 described above is cleaned for the purpose of eliminating the clogging of the nozzles N or the like, by supplying, instead of the ink, a fluid for use for cleaning, such as a cleaning liquid. In this case, if the liquid discharge head 26 is detached from the liquid discharge apparatus 10 to perform cleaning, inconveniently large amount of labor and time are required. Therefore, the liquid discharge apparatus 10 in this exemplary embodiment is designed so that the liquid discharge head 26 can be cleaned without a need to detach the liquid discharge head 26 from the liquid discharge apparatus 10.

Figure 3:
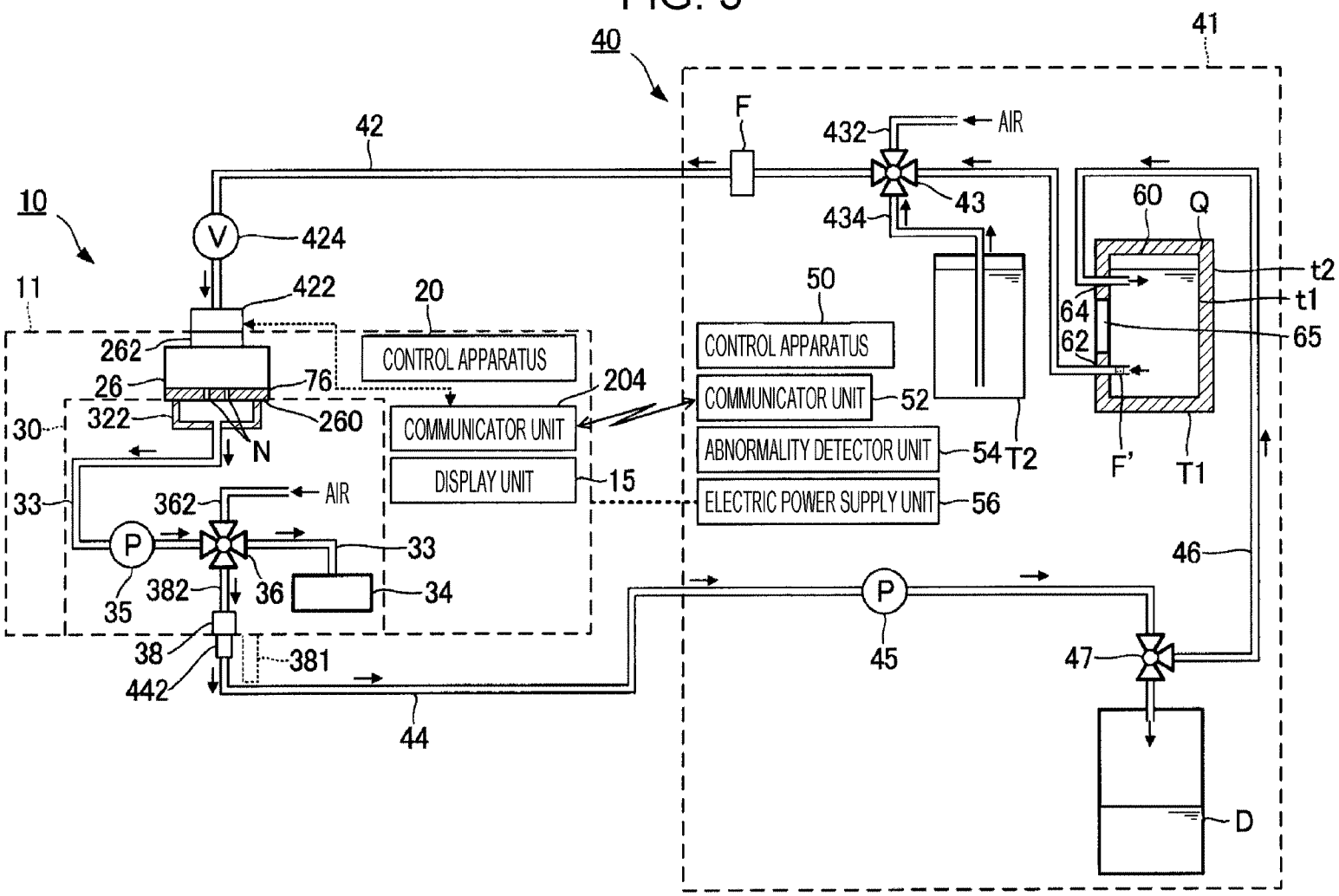
FIG. 3 is a diagram for describing a configuration of a cleaning apparatus for a liquid discharge head.

A configuration of the liquid discharge apparatus 10 and a configuration of a cleaning apparatus 40 that cleans the liquid discharge head 26 will be described below. FIG. 3 is a diagram for describing a configuration of the cleaning apparatus 40 of the liquid discharge head 26 according to this exemplary embodiment. The cleaning apparatus 40 illustrated in FIG. 3 is separate from the liquid discharge apparatus 10 and is attached to the liquid discharge apparatus 10 by a user at the time of cleaning operation. FIG. 3 illustrates a state in which the cleaning apparatus 40 has been attached to the liquid discharge apparatus 10 with the liquid discharge head 26 held in the non-printing region H.

As illustrated in FIG. 3, the liquid discharge apparatus 10 of this exemplary embodiment includes an outlet opening 38 through which the fluid emitted from the nozzles N can be let out of the casing 11 instead of being let out into the waste liquid tank 34 provided within the casing 11. Therefore, the fluid (the cleaning liquid, the ink, air, etc.) emitted from the nozzles N by supplying the fluid (the cleaning liquid or air) for cleaning to the liquid discharge head 26 can be let out of the casing 11 through the outlet opening 38 without being let out into the waste liquid tank 34 provided within the casing 11. Therefore, without a need to detach the liquid discharge head 26 from the liquid discharge apparatus 10 nor a need to use the waste liquid tank 34, it is possible to vigorously clean the liquid discharge head 26 with a large amount of the cleaning liquid and, furthermore, efficiently clean the liquid discharge head 26 by circulating the cleaning liquid.

Therefore, in comparison with the case where the liquid discharge head 26 is detached from the liquid discharge apparatus 10 before being cleaned, the cleaning time for the liquid discharge head 26 can be shortened and, furthermore, the vigorous cleaning of the liquid discharge head 26 is possible without having to increase the size of the waste liquid tank 34 provided in the casing 11, so that the liquid discharge apparatus 10 itself can be reduced in size. Thus, this exemplary embodiment reduces the cleaning time for the liquid discharge head 26 and also allows size reduction of the liquid discharge apparatus 10.

The liquid discharge apparatus 10 includes a cover 381 that covers the outlet opening 38. The cover 381 is provided on the casing 11 so as to be capable of being opened and closed. When the outlet opening 38 is to be used, the cover 381 is opened. When the outlet opening 38 is not in use, the cover 381 can be closed. This prevents dust from entering through the outlet opening 38.

The waste liquid tank 34 is provided with the waste liquid flow path 33. An end of the waste liquid flow path 33 is connected to the cap 322 and the other end of the waste liquid flow path 33 is connected to the waste liquid tank 34. Therefore, the waste liquid tank 34 communicates with the nozzles N via an internal space of the cap 322, through the waste liquid flow path 33.

A switching valve 36 is provided at an intermediate location on the waste liquid flow path 33. The switching valve 36 communicates with the outlet opening 38 through an outlet flow path 382. The switching valve 36 is controlled by the control unit 202 and is capable of switching between causing the fluid emitted from the nozzles N to be let out into the waste liquid tank 34 and causing the fluid to be let out through the outlet opening 38. Therefore, using the switching valve 36, the fluid emitted from the nozzles N can be selectively let out of the casing 11 through the outlet opening 38, instead of being let out into the waste liquid tank 34 provided in the casing 11. This makes it possible to choose either to use the waste liquid tank 34 or not to use the waste liquid tank 34, so that the service life of the waste liquid tank 34 can be increased. Furthermore, of the waste liquid flow path 33, a flow path extending from the nozzles N to the switching valve 36 can be used both when the fluid emitted from the nozzles N is let out into the waste liquid tank 34 and when the fluid emitted from the nozzles N is let out through the outlet opening 38.

Note that diameters of the outlet opening 38 and the outlet flow path 382, which provides communication between the outlet opening 38 and the switching valve 36, are larger than at least a diameter of the waste liquid flow path 33. According to this configuration, large amounts of fluid, such as the cleaning liquid, can be efficiently let out via the outlet opening 38, so that the liquid discharge head 26 can be effectively cleaned. The "diameter" here means an inside diameter of a passageway. When any one of the outlet flow path 382, the outlet opening 38, and the waste liquid flow path 33 has portions whose diameters are different, the "diameter" is, for example, an average diameter of that passageway, and, more preferably, a minimum diameter of the passageway.

Furthermore, an atmospherically open flow path 362 that communicates with the atmosphere is connected to the switching valve 36. By switching the switching valve 36 so that the waste liquid flow path 33 or the outlet flow path 382 communicates with the atmospherically open flow path 362, air is introduced into the waste liquid flow path 33 or the outlet flow path 382, which therefore become atmospherically open. By atmospherically opening the switching valve 36, the fluid, such as ink and the cleaning liquid remaining in the outlet opening 38 after the cleaning, can be effectively let out. This will inhibit the flowing down or dripping of the fluid remaining in the outlet opening 38.

Of the waste liquid flow path 33, a flow path between the cap 322 and the switching valve 36 is provided with the pump 35. By operating the pump 35, the ink or the cleaning liquid can be sucked from the cap 322, forced out into the cap 322, and moved from the cap 322 toward the waste liquid tank 34 or the outlet opening 38 through the waste liquid flow path 33. Furthermore, the fluid emitted from the nozzles N can be forced out of the casing 11 through the outlet opening 38 by using the pump 35 provided within the casing 11. Incidentally, the fluid can also be forced out of the casing 11 through the outlet opening 38 by using a pump provided outside the casing 11 (e.g., a pump 45 (described later) of the cleaning apparatus 40, instead of using the pump 35 provided in the casing 11. Therefore, instead of increasing the size of the pump 35 in the casing 11, it is possible to use a powerful pump provided outside the casing 11 in order to accomplish vigorous cleaning, so that the liquid discharge apparatus 10 can be reduced in size.

As illustrated in FIG. 3, the cleaning apparatus 40 in this exemplary embodiment is able to supply the fluid for cleaning (the cleaning liquid, air, etc.) from the attaching portion 262 of the liquid discharge head 26 and emit the fluid emitted from the nozzles N out of the casing 11 through the outlet opening 38. By using the cleaning apparatus 40 configured as described above, the liquid discharge head 26 can be cleaned while the liquid discharge head 26 remains attached to the liquid discharge apparatus 10.

The cleaning apparatus 40 includes a casing 41. Inside the casing 41 there are provided a control apparatus 50, a first tank T1, a second tank T2, a waste liquid tank D, a switching valve 43, a switching valve 47, and a pump 45. The control apparatus 50 control various components and the like of the cleaning apparatus 40, including the switching valve 43, the switching valve 47, and the pump 45. The first tank T1 stores a first cleaning liquid and the second tank T2 stores a second cleaning liquid. The waste liquid tank D stores the fluid discarded by the cleaning apparatus 40. Incidentally, the first tank T1, the second tank T2, and the waste liquid tank D may be configured so as to be separately replaceable in the form of a detachable cartridge.

The cleaning apparatus 40 includes an electric power supply unit 56 that is supplied with electric power from the liquid discharge apparatus 10 and that supplies electric power to various components and the like. The electric power supply unit 56 of the cleaning apparatus 40 is supplied with electric power from the liquid discharge apparatus 10, for example, by connecting the electric power supply unit 56 to an interface that is provided on the liquid discharge apparatus 10 side. This configuration eliminates the need to provide an electric power supply on the cleaning apparatus 40 side and thus allows the cleaning apparatus 40 to be reduced in size. However, it is also possible to provide an electric power supply on the cleaning apparatus 40 side.

In this exemplary embodiment, the first tank T1 is in a circulatory cleaning step (described later) in which cleaning is performed while the first cleaning liquid is being circulated through the liquid discharge head 26, and the second tank T2 is used in a non-circulatory cleaning step (described later) in which cleaning is performed without circulating the second cleaning liquid through the liquid discharge head 26. Thus, in this exemplary embodiment, the fluid for use in the circulatory cleaning step and the fluid for use in the non-circulatory cleaning step can be separate from each other. The first cleaning liquid and the second cleaning liquid are concrete examples of fluids for use for cleaning the liquid discharge head 26. The first cleaning liquid and the second cleaning liquid may be the same kind of cleaning liquid or different kinds of cleaning liquids. When the first tank T1 and the second tank T2 store different kinds of fluids, the circulatory cleaning step and the non-circulatory cleaning step can use mutually different kinds of liquids for cleaning. Furthermore, it is possible to adopt an arrangement in which the second tank T2 for use for non-circulatory cleaning is not heated and the first tank T1 for use for circulatory cleaning is heated. This arrangement can increase the cleaning effect of circulatory cleaning. The method of using the first tank T1 and the second tank T2 is not limited to what are mentioned as examples.

The cleaning apparatus 40 includes a supply flow path 42 that supplies a fluid (the first cleaning liquid, the second cleaning liquid, etc.) for use for cleaning to the liquid discharge head 26, a recovery flow path 44 for recovering the fluid emitted from the outlet opening 38, and a circulation flow path 46 for moving the fluid from the recovery flow path 44 to the supply flow path 42. The first tank T1 is provided on the circulation flow path 46 and the second tank T2 is provided on the supply flow path 42.

The supply flow path 42 is a passageway that provides communication between the liquid discharge head 26 and the first tank T1. The supply flow path 42 can also communicate with the second tank T2 via the switching valve 43. Specifically, the switching valve 43 is provided on an intermediate portion of the supply flow path 42 and communicates also with a supply flow path 434 that extends from the second tank T2. The switching valve 43 is capable of switching between a state for supplying the first cleaning liquid from the first tank T1 to the liquid discharge head 26 through the supply flow path 42 and a state for supplying the second cleaning liquid from the second tank T2 to the liquid discharge head 26 through the supply flow path 42.

A portion of the supply flow path 42 extends out of the casing 41 and is detachably connected to the liquid discharge head 26. Concretely, an end portion of the portion of the supply flow path 42 which extends outside the casing 41 is provided with a connecting portion 422 for connecting the supply flow path 42 to the liquid discharge head 26. The connecting portion 422 is capable of being attached to the attaching portion 262 of the liquid discharge head 26 while replacing the connecting portion 142 of the liquid supply source 14. This single attaching portion 262 allows the connecting portion 142 of the liquid supply source 14 and the connecting portion 422 of the supply flow path 42 to be interchangeably connected to the same site. Therefore, the attaching portion 262 can be simplified in configuration or structure in comparison with the case where the connecting portions 142 and 422 are connected to mutually different sites.

Concretely, the connecting portion 422 has substantially the same shape as the connecting portion 142, and is a connector (a jig for supplying a cleaning liquid) that has a hole for communicating with an ink supply needle or an ink supply hole of the attaching portion 262. In the case where the attaching portion 262 is provided with a plurality of ink supply needles or ink supply holes for introducing different color inks, both the connecting portion 422 and the connecting portion 142 are provided with holes that correspond to the ink supply needles or the ink supply holes. In this case, the shape of the connecting portion 422 seen from the attaching portion 262 may be asymmetric (e.g., left-right asymmetric). This configuration ensures that the attaching portion 262 so that each one of the ink supply needles or the ink supply holes communicate with the same one of the holes of the connecting portion 422 when the connecting portion 422 is attached to the attaching portion 262 and therefore will prevent mixture of different color inks even when the connecting portion 422 is repeatedly attached to and detached from the attaching portion 262.

As illustrated in FIG. 3, the liquid discharge apparatus 10 includes a communicator unit 204 that communicates with the liquid supply source 14 wirelessly or by wire. On the basis of results of communication of the communicator unit 204, the switching valve 36 is switched to such a state that a flow path for emitting the fluid emitted from the nozzles N communicates with the waste liquid tank 34 or such a state that the flow path for emitting the fluid emitted from the nozzles N communicates with the outlet opening 38. The communication by the communicator unit 204 and the switching control of the switching valve 36 are carried out by the control unit 202 of the liquid discharge apparatus 10.

For example, the control unit 202 acquires information from integrated circuit (IC) chips (tags) or radio frequency (RF) chips (tags) provided on the connecting portion 142 of the liquid supply source 14 or the connecting portion 422 of the cleaning apparatus 40 (such as identification information on the liquid supply source 14 or the cleaning apparatus 40, and the like), by using the communicator unit 204. For example, when information about the liquid supply source 14 is successfully acquired, the control unit 202 determines that the connecting portion 142 of the liquid supply source 14 is connected to the attaching portion 262 (the cleaning is not being performed). On the other hand, when information about the liquid supply source 14 is not acquired, the control unit 202 determines that the connecting portion 142 of the liquid supply source 14 is not connected to the attaching portion 262 (the cleaning is being performed). Alternatively, it may be determined that the connecting portion 422 of the cleaning apparatus 40 is connected to the attaching portion 262 (the cleaning is being performed) when information about the cleaning apparatus 40 is successfully acquired, and it may be determined that the connecting portion 422 of the cleaning apparatus 40 is not connected to the attaching portion 262 (the cleaning is not being performed) when information about the cleaning apparatus 40 is not acquired. The control unit 202, after having determined that the cleaning is not being performed, switches the switching valve 36 so that the fluid emitted from the nozzles N is emitted into the waste liquid tank 34. On the other hand, after having determined that the cleaning is being performed, the control unit 202 switches the switching valve 36 so that the fluid emitted from the nozzles N is emitted through the outlet opening 38. Since the switching valve 36 is automatically switched by the liquid discharge apparatus 10 in this manner, incorrect operation of the switching valve 36 initiated by a user can be effectively inhibited in comparison with the case where a user switches the switching valve 36.

Note that the atmospherically open flow path 432 that communicates with the atmosphere is connected to the switching valve 43 and therefore the switching valve 43 functions also as an atmospherically openable valve. If, by using the switching valve 43, the communication between the first tank T1 and the second tank T2 is cut off and communication of the atmospherically open flow path 432 with the supply flow path 42 is established, air can be sent from the atmospherically open flow path 432 into the liquid discharge head 26 via the supply flow path 42. This allows air to expel the fluid remaining in the liquid discharge head 26. Therefore, air in this operation is encompassed within the fluid that is used for cleaning. Furthermore, when the switching valve 43 is atmospherically opened, the fluid remaining in the supply flow path 42 after cleaning can also be effectively expelled. This, for example, inhibits the flowing down or dripping of the fluid remaining in the supply flow path 42 when the connecting portion 422 of the supply flow path 42 is detached.

An open/close valve 424 that opens and closes the supply flow path 42 is provided in an intermediate portion of the supply flow path 42. The open/close valve 424 may be made up of, for example, a choke valve that is capable of changing the extent to which the valve opens. With this configuration, by closing the open/close valve 424, for example, when the connecting portion 422 is detached from the attaching portion 262 of the liquid discharge head 26, it is possible to inhibit the flowing down or dripping of the fluid remaining in the supply flow path 42. Incidentally, an intermediate portion of the supply flow path 42 may be provided with, for example, a negative pressure generating mechanism such as a self-sealing valve. By producing negative pressure in the supply flow path 42 by using the negative pressure generating mechanism, the flowing down or dripping of the fluid remaining in the supply flow path 42 can be inhibited, for example, when the connecting portion 422 of the supply flow path 42 is detached. An intermediate portion of the supply flow path 42 may be provided with either one or both of the negative pressure generating mechanism and the open/close valve 424.

A filter F is provided in an intermediate portion of the supply flow path 42. The filter F removes undesirable substances contained in the fluid passing through the supply flow path 42. Therefore, for example, during the circulatory cleaning of the liquid discharge head 26, the fluid from which undesirable substances are removed by the filter F can be returned to the liquid discharge head 26 through the supply flow path 42. This will reduce the burden that cleaning causes on a filter in the liquid discharge apparatus 10 and therefore can prolong the service life of the filter provided in the liquid discharge apparatus 10. Although the filter F is provided in the supply flow path 42 in the foregoing example, this arrangement does not limit the scope of the invention but a filter F may be provided in the recovery flow path 44 or the circulation flow path 46. The filter arrangement is not limited to one filter F but may include a plurality of filters F.

The recovery flow path 44 is a passageway that provides communication between the outlet opening 38 of the liquid discharge apparatus 10 and the waste liquid tank D. A portion of the recovery flow path 44 extends outside the casing 41 and is detachably connected to the outlet opening 38. Concretely, of the recovery flow path 44, an end portion of the portion extending outside the casing 41 is provided with a connecting portion 442 for detachable connection with the outlet opening 38. For example, the connecting portion 442 is a joint detachably attachable to the outlet opening 38. When the connecting portion 442 is to be coupled to the outlet opening 38, the cover 381 of the outlet opening 38 is opened before the coupling. Thus, via the connecting portion 442, the outlet opening 38 and the recovery flow path 44 communicate with each other.

The switching valve 47 is provided in an intermediate portion of the recovery flow path 44 and communicates also with the circulation flow path 46. The switching valve 47 is capable of switching between a state that provides communication between the outlet opening 38 and the waste liquid tank D and a state that provides communication between the outlet opening 38 and the circulation flow path 46. An intermediate portion of the recovery flow path 44 is provided with the pump 45. In an example this exemplary embodiment presented here, the pump 45 is provided between the switching valve 47 and the connecting portion 442. The pump 45 of the cleaning apparatus 40 can move the fluid emitted from the nozzles N of the liquid discharge head 26 toward the recovery flow path 44 via the outlet opening 38, not by applying positive pressure but by suction. Therefore, undesirable substances, bubbles, etc. in the liquid discharge head 26 can be effectively emitted.

The pump 45 of the cleaning apparatus 40 may generate a greater suction force (moving force) than the pump 35 of the liquid discharge apparatus 10. According to this pump 45, by using the pump 45 of the cleaning apparatus 40, which is more powerful than the pump 35, while omitting the use of the pump 35 of the liquid discharge apparatus 10, the fluid emitted from the nozzles N can be moved into the recovery flow path 44 via the outlet opening 38. Therefore, vigorous cleaning can be accomplished without having to increase the size of the pump 35 of the liquid discharge apparatus 10, so that the liquid discharge apparatus 10 can be reduced in size. Although this exemplary embodiment has been described in conjunction with an example in which the pump 45 is provided with the switching valve 47 and the connecting portion 442, the location where the pump 45 is disposed is not limited to the foregoing location.

Furthermore, it is also possible to adopt an arrangement in which, when the liquid discharge head 26 is cleaned, the pump 35 provided in the liquid discharge apparatus 10 is used to move fluid, such as the cleaning liquid emitted from the nozzles N, to the outlet opening 38. This arrangement increases the efficiency of moving the fluid emitted from the nozzles N, so that the liquid discharge head 26 can be more effectively cleaned than in the case where the pump 35 is not used. Furthermore, use of the pump 35 provided in the liquid discharge apparatus 10 makes it possible to suck the fluid emitted from the nozzles N and emit the fluid out. In the case where the suction of the fluid emitted from the nozzles N is employed, the pump 35 may be operated so as to produce greater suction force at the time of sucking the fluid, such as the cleaning liquid or the like emitted from the nozzles N, for example, by operating the pump 35 at higher rotation speed, than at the time of sucking from the nozzles N the ink supplied from the liquid supply source 14. This arrangement allows the liquid discharge head 26 to be effectively cleaned even in the case where the pump 35 provided in the liquid discharge apparatus 10 is used to clean the liquid discharge head 26. Incidentally, the cleaning of the liquid discharge head 26 may uses both the pump 35 and the pump 45 or may also use one of the pumps 35 and 45.

The circulation flow path 46 is a passageway that provides communication between the recovery flow path 44 and the supply flow path 42 via the first tank T1. Because the circulation flow path 46 is provided, the fluid recovered via the recovery flow path 44 can be returned to the supply flow path 42 via the circulation flow path 46 and therefore the fluid can be re-supplied to the liquid discharge head 26. This makes it possible to perform the circulatory cleaning in which the liquid used for cleaning is circulated through the liquid discharge head 26, so that the liquid discharge head 26 can be effectively cleaned without using a large amount of the liquid. The circulation flow path 46 is connected to the switching valve 47 provided in the recovery flow path 44 and to the first tank T1 and extends through an internal flow path within the first tank T1. In this description, a flow path extending from the switching valve 47 to the internal flow path of the first tank T1 is termed the circulation flow path 46.

Figure 4:
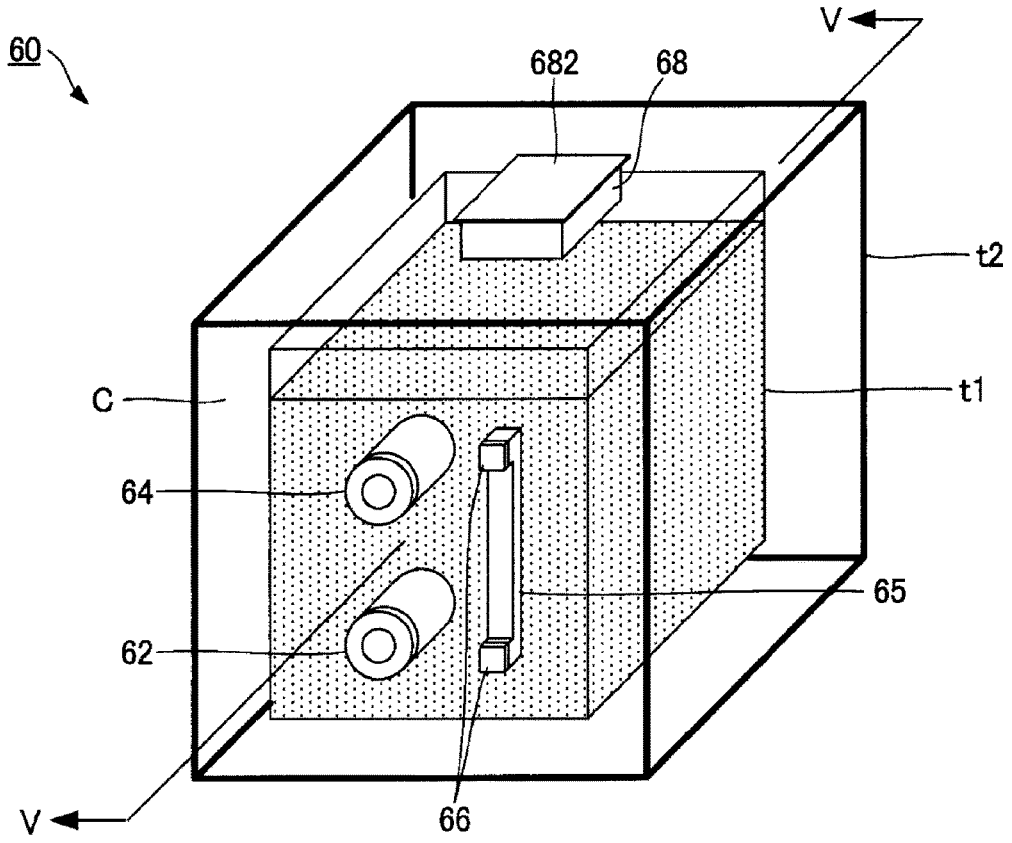
FIG. 4 is an external perspective view illustrating a configuration of a cartridge.
Figure 5:
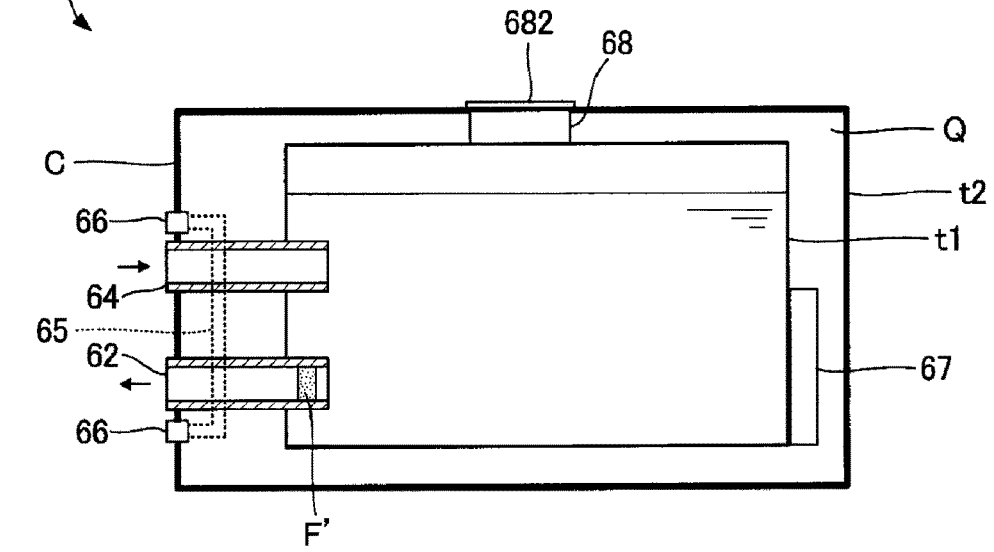
FIG. 5 is a sectional view of the cartridge taken on line V-V in FIG. 4.

A configuration example of the first tank T1 will be described below. As indicated in FIG. 3, the first tank T1 may be made up of a cartridge 60 as illustrated in FIG. 4 and FIG. 5. FIG. 4 is an external perspective view illustrating a configuration of the cartridge 60. The cartridge 60 is a configured to be detachably attachable to the cleaning apparatus 40. The first tank T1 (cartridge 60), as illustrated in FIGS. 3 to 5, includes a storage chamber t1 that stores a fluid, a supply opening 62 for supplying the fluid stored in storage chamber t1 to the supply flow path 42, and a recovery opening 64 for recovering the fluid from the recovery flow path 44 into the storage chamber t1. The supply opening 62 and the recovery opening 64 both communicate with the storage chamber t1 and, together with the storage chamber t1, form an internal flow path in the first tank T1 (cartridge 60) through which the circulation flow path 46 extends. In the case where the first tank T1 is used for circulatory cleaning, the fluid stored in the storage chamber t1 is only the first cleaning liquid before cleaning starts but, after cleaning starts, is supplied to the liquid discharge head 26 and therefore mixes with remaining ink or the like to form a mixture fluid, which is then emitted through the outlet opening 38 and recovered from the recovery opening 64 into the storage chamber t1 via the recovery flow path 44. In the case where the first tank T1 in this exemplary embodiment is the cartridge 60, which is a detachably attachable cartridge that partially forms the internal flow path through which the circulation flow path 46 for circulating the fluid for cleaning extends and that stores the fluid, the cartridge 60 has an advantage of allowing size reduction in comparison with a cartridge that has not only the circulation flow path 46 for cleaning liquid but also a circulation flow path for ink. Furthermore, the cartridge 60 can be easily attached to the flow path of the cleaning apparatus 40, because of the supply opening 62 and the recovery opening 64.

The supply opening 62 is provided with a filter F'. The filter F' removes undesirable substances contained in the fluid supplied from the supply opening 62 into the supply flow path 42. Therefore, for example, during the circulatory cleaning of the liquid discharge head 26, even if the fluid recovered from the recovery opening 64 contains undesirable substances, a fluid from which undesirable substances have been removed by the filter F' can be returned to the liquid discharge head 26 through the supply flow path 42. Although the exemplary embodiment has been described in conjunction with an example in which the filter F' is provided only in the supply opening 62, this does not limit the invention but the filter F may be provided in the recovery opening 64 and, furthermore, both the supply opening 62 and the recovery opening 64 may be provided with filters F'.

The first tank T1 is provided with a temperature adjuster unit 65 that adjusts the temperature of the fluid stored in the storage chamber t1. As illustrated in FIG. 3, the first tank T1 includes a surrounding portion t2 that surrounds the storage chamber t1 so that a space Q is formed between the surrounding portion t2 and a wall surface of the storage chamber t1. In this exemplary embodiment, the storage chamber t1 has a substantially box shape and the surrounding portion t2 has a substantially box shape that is slightly larger than the storage chamber t1 so that the space Q is formed between the storage chamber t1 and the surrounding portion t2. Note that the storage chamber t1 is fixed by ribs (not depicted) provided within the surrounding portion t2. The space Q is filled with a heating medium. The temperature adjuster unit 65 adjusts the temperature of the heating medium to adjust the temperature of the liquid stored in the storage chamber t1. The heating medium is a liquid for water bath. However, the heating medium may be a gas such as air or nitrogen. In this arrangement, the temperature of the fluid in the storage chamber t1 can be indirectly adjusted from outside the storage chamber t1, by using the heating medium. The temperature of the fluid can be set to a temperature that is suitable to the ink filling capability and the cleaning liquid for the liquid discharge head 26 (i.e., wettability of the inside of the flow path should be increased to facilitate supply of the ink). The liquid in the storage chamber t1, for example, is heated to a predetermined temperature (e.g., 40° C. to 70° C.) that is higher than normal temperature (e.g., 15° C. to 25° C.). This enhances the effect of the circulatory cleaning that employs the first tank T1. Although the liquid in the storage chamber t1 is warmed by the temperature adjuster unit 65 as described above, the liquid in the storage chamber t1 may be cooled. Each of the storage chamber t1 and the surrounding portion t2 is at least partially formed by a transparent material. In this arrangement, because an interior of the storage chamber t1 can be seen, the amount and color of the fluid within the storage chamber t1 can be checked. The storage chamber t1 and the surrounding portion t2 may also be formed not only partially but entirely by a transparent member.

As stated above, in the case where the first tank T1 is the cartridge 60, the cartridge 60 may include electric power supply terminals 66 that are supplied with electric power, as illustrated in FIGS. 4 and 5. When the cartridge 60 is fit to the cleaning apparatus 40, the electric power supply terminals 66 come into contact with and are therefore electrically coupled terminals (not depicted) on the cleaning apparatus 40 side which are connected to the electric power supply unit 56. Therefore, electric power from the electric power supply unit 56 is supplied to the foregoing temperature adjuster unit 65. This eliminates the need to provide on the cartridge 60 side an electric power supply that supplies electric power to the temperature adjuster unit 65 and therefore allows the cartridge 60 to be reduced in size.

As illustrated in FIGS. 4 and 5, the electric power supply terminals 66 of the cartridge 60 are disposed on a surface C that is the same as a surface on which the supply opening 62 and the recovery opening 64 are provided. This facilitates the attachment and detachment of the electric power supply terminals 66 and enhances the contact of the electric power supply terminals 66 on the cartridge 60 side with the terminals (not depicted) on the cleaning apparatus 40 side.

Although in an example construction of the exemplary embodiment, the first tank T1 is made of the cartridge 60, the second tank T2 and waste liquid tank D may also be made of cartridges. Where the cartridge 60 that forms the first tank T1 is termed a first cartridge and the cartridge that forms the second tank T2 is termed a second cartridge, the first cartridge is detachably attachable to the circulation flow path 46 and the second cartridge is detachably attachable to the supply flow path 42. However, the second cartridge may be provided so as to be detachably attachable to the circulation flow path 46. Furthermore, the storage chamber t1 has an atmospherically open hole 68 that extends through the surrounding portion t2, the atmospherically open hole 68 is closed by a sealing member 682 that passes air, so that undesirable substances do not enter.

As illustrated in FIG. 3, the cleaning apparatus 40 includes a communicator unit 52 that communicates with the communicator unit 204 of the liquid discharge apparatus 10 wirelessly or by wire. Using the communicator unit 52, the cleaning apparatus 40 can exchange various kinds of information with the liquid discharge apparatus 10. For example, the information sent to the liquid discharge apparatus 10 by the communicator unit 52 includes information that is to be displayed by a display unit 15 that is provided on the liquid discharge apparatus 10. This eliminates the need to provide a display unit on the cleaning apparatus 40 side and allows the number of component parts to be reduced. However, a display unit may be provided on the cleaning apparatus 40 side so as to display the aforementioned information. Furthermore, the information sent to the liquid discharge apparatus 10 by the communicator unit 52 also includes information on the progress of the cleaning of the liquid discharge head 26. This allows the liquid discharge apparatus 10 to perform an operation according to the status of progress of the cleaning. For example, when an abnormality occurs such that the cleaning operation is interrupted partway through, the liquid discharge apparatus 10 can store the then status of progress in the storage unit 203, so that, after the abnormality is removed, the cleaning operation can be restarted following the point of interruption.

As illustrated in FIG. 3, the cleaning apparatus 40 includes an abnormality detector unit 54 that detects abnormality. The abnormality detector unit 54 is capable of detecting, for example, liquid leaks from the cartridge 60, other tanks, various flow paths, etc., overheating caused by the temperature adjuster unit 65 of the cartridge 60, overload of a motor of the pump 45, etc. The information sent to the liquid discharge apparatus 10 by the communicator unit 52 includes information detected by the abnormality detector unit 54. Because of this, for example, when a liquid leak, overheating, overload of the motor, etc., is detected by the abnormality detector unit 54, such an abnormality can be notified to a user or the cleaning operation can be interrupted.

The cartridge 60 may be provided with a remaining amount detector unit 67 that detects the amount of the fluid remaining in the storage chamber t1 and the information sent to the liquid discharge apparatus 10 by the communicator unit 52 may include information on the remaining amount of the fluid detected by the remaining amount detector unit 67. This allows the liquid discharge apparatus 10 to operate according to the amount of the fluid remaining in the cartridge 60. For example, according to the amount of the fluid remaining in the cartridge 60, the liquid discharge apparatus 10 can prompt a user to replace the cartridge 60 or can interrupt the cleaning operation. Information on the remaining amount of the fluid may be displayed on the display unit 15 of the liquid discharge apparatus 10.

Furthermore, the cartridge 60 may also be provided with a lock mechanism (not depicted) that makes attachment of the cleaning apparatus 40 to a locked state or an unlocked state. The lock mechanism may be configured, for example, so that a hook provided on the cartridge 60 engages with the cleaning apparatus 40. Furthermore, the cleaning apparatus 40 may be provided with a lock detector unit (not depicted) that detects a state of the lock mechanism, so that, according to a result of detection by the lock detector unit, the control apparatus 50 will control the cleaning apparatus 40. For example, when the lock detector unit detects a locked state, the control apparatus 50 determines that the cartridge 60 has been attached, and then starts the cleaning operation. On the other hand, when the lock detector unit detects an unlocked state, the control apparatus 50 determines that the cartridge 60 has been removed, and then prohibits the starting of the cleaning operation. Furthermore, the connecting portion 422 and the connecting portion 442 may each be provided with a lock mechanism and an lock detector unit.

Figure 6:
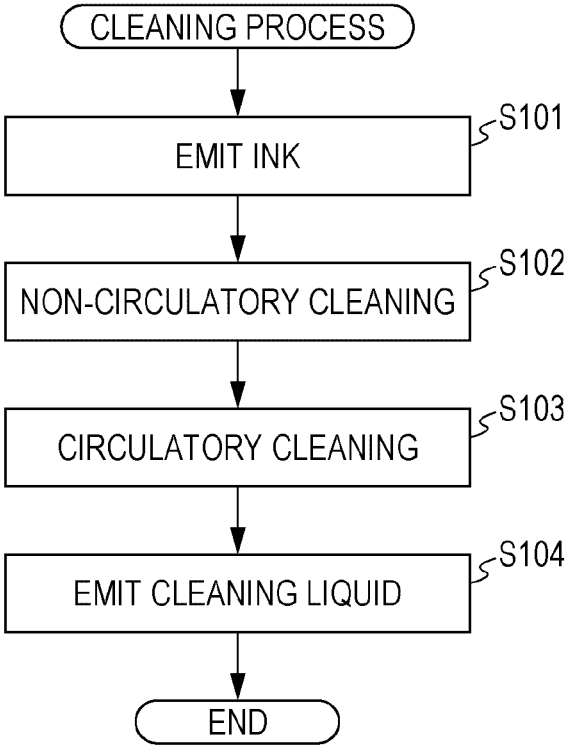
FIG. 6 is a flowchart illustrating a cleaning process for the liquid discharge head.

Next, a method of cleaning the liquid discharge head 26 by using the cleaning apparatus 40 according to the exemplary embodiment will be described with reference to the drawings. FIG. 6 is a flowchart illustrating a cleaning process for the liquid discharge head 26 which is performed by the control apparatus 50 of the cleaning apparatus 40 according to the exemplary embodiment. When the liquid discharge head 26 is to be cleaned, the connecting portion 142 of the liquid supply source 14 is detached from the attaching portion 262 of the liquid discharge head 26. Then, as illustrated in FIG. 3, the connecting portion 422 of the cleaning apparatus 40 is connected to the attaching portion 262 of the liquid discharge head 26, and the connecting portion 442 of the cleaning apparatus 40 is connected to the outlet opening 38 of the liquid discharge apparatus 10. At this time, in the case where the first tank T1 or the like is a cartridge 60 or the like, the cartridge 60 as the first tank T1 and cartridges as the second tank T2 and the waste liquid tank D are attached in the cleaning apparatus 40.

With the cleaning apparatus 40 connected to the liquid discharge apparatus 10 in this manner, the cleaning of the liquid discharge head 26 by the cleaning apparatus 40 is started after the switching valve 36 is switched so that fluid emitted from the nozzles N is emitted through the outlet opening 38 without being emitted into the waste liquid tank 34, while the liquid discharge head 26 remains attached to the liquid discharge apparatus 10. The switching valve 36 may be switched by the control unit 202 of the control apparatus 20 on the liquid discharge apparatus 10 side in an automatic manner as mentioned above or by the control unit 202 on the basis of a command from a user input via an operation panel (not depicted) of the liquid discharge apparatus 10.

As illustrated in FIG. 6, first, in step S101, the control apparatus 50 supplies air, as a fluid for cleaning, to the liquid discharge head 26 so as to emit ink from the liquid discharge head 26. Concretely, the control apparatus 50 switches the switching valve 43 to an atmospherically open state and switches the switching valve 47 so that the recovery flow path 44 communicates with the waste liquid tank D, and then operates the pump 45 for a predetermined time (e.g., about 10 seconds). Thus, by supplying air from the switching valve 43 to the liquid discharge head 26 through the supply flow path 42, the ink remaining in the liquid discharge head 26 is expelled from the nozzles N (first step). The ink emitted from the nozzles N is recovered into the recovery flow path 44 via the outlet opening 38 (second step) and then emitted into the waste liquid tank D. Since the pump 45 is used to suck ink from the nozzles N into the recovery flow path 44, the ink emitting efficiency can be increased.

Next, in step S102, the control apparatus 50 performs non-circulatory cleaning by supplying the second cleaning liquid, a fluid for cleaning, to the liquid discharge head 26 (non-circulatory cleaning step). By the non-circulatory cleaning, the interior of the cap 322 and the flow path through which the second cleaning liquid passes are cleaned. Concretely, the control apparatus 50 switches the switching valve 43 so that the supply flow path 42 communicates with the second tank T2, and then operates the pump 45 for a predetermined time (e.g., about 15 seconds). Thus, by supplying the second cleaning liquid from the second tank T2 to the liquid discharge head 26 through the supply flow path 42, fluid, such as waste liquid or air from the cleaning, is emitted from the nozzles N (first step). The fluid emitted from the nozzles N is emitted through the outlet opening 38, recovered into the recovery flow path 44 (second step), and then emitted into the waste liquid tank D.

Next, in step S103, the control apparatus 50 performs circulatory cleaning by supplying the first cleaning liquid, a fluid for cleaning, to the liquid discharge head 26 (circulatory cleaning step). By performing the circulatory cleaning to circulate the first cleaning liquid, the interior of the cap 322 and the flow path through which the second cleaning liquid passes are further cleaned. Therefore, clogging of the nozzles N or the like can be removed. Concretely, the control apparatus 50 switches the switching valve 43 so that the supply flow path 42 communicates with the first tank T1, switches the switching valve 47 so that the recovery flow path 44 communicates with the circulation flow path 46, and then operates the pump 45 for a predetermined time (e.g., about 10 seconds).

Thus, by supplying the first cleaning liquid from the first tank T1 to the liquid discharge head 26 through the supply opening 62 and the supply flow path 42, fluid, such as waste liquid or air from the cleaning, is emitted from the nozzles N (first step). The fluid emitted from the nozzles N is emitted through the outlet opening 38 and is recovered into the recovery flow path 44 (second step). The fluid recovered into the recovery flow path 44 is not emitted into the waste liquid tank D but returned to the first tank T1 through the circulation flow path 46 and the recovery opening 64 and then is supplied again through the supply opening 62 to the liquid discharge head 26 via the supply flow path 42, so that fluid is emitted from the nozzles N (third step). The second step and the third step are repeatedly performed to carry out the circulatory cleaning of the liquid discharge head 26. Thus, according to the exemplary embodiment, it is possible to perform the circulatory cleaning of the liquid discharge head 26 while the liquid discharge head 26 remains attached to the liquid discharge apparatus 10. In the circulatory cleaning, since the fluid stored in the first tank T1 is heated to a predetermined temperature that is higher than normal temperature, the advantageous effect of the circulatory cleaning can be enhanced.

Next, in step S104, the control apparatus 50 emits the cleaning liquid remaining in the liquid discharge head 26 as a result of the circulatory cleaning (the second cleaning liquid in this case) out into the waste liquid tank D, completing the series of cleaning processes. Concretely, the control apparatus 50 switches the switching valve 43 to the atmospherically open state, switches the switching valve 47 so that the recovery flow path 44 communicates with the waste liquid tank D, and then operates the pump 45 for a predetermined time (e.g., about 10 seconds). Thus, the second cleaning liquid in the liquid discharge head 26 is expelled from the nozzles N by supplying the liquid discharge head 26 with air from the switching valve 43 through the supply flow path 42. At this time, the fluid remaining in the outlet opening 38 is also expelled by the air. This inhibits the flowing down or dripping of the fluid remaining in outlet opening 38 of the liquid discharge apparatus 10 when the connecting portion 442 of the cleaning apparatus 40 is detached from the outlet opening 38.

After the cleaning process by the cleaning apparatus 40 illustrated in FIG. 4 is completed, the connecting portion 422 of the cleaning apparatus 40 is detached from the attaching portion 262 of the liquid discharge head 26, the connecting portion 442 of the cleaning apparatus 40 is detached from the outlet opening 38 of the liquid discharge apparatus 10, and then the cover 381 is closed. At this time, closing the open/close valve 424 before detaching the connecting portion 422 of the cleaning apparatus 40 inhibits the flowing down or dripping of the fluid remaining in the supply flow path 42.

Subsequently, the connecting portion 142 of the liquid supply source 14 is attached to the attaching portion 262 of the liquid discharge head 26, and the switching valve 36 is switched so that the fluid emitted from the nozzles N is emitted into the waste liquid tank 34. Then, the liquid discharge head 26 is filled with ink. After the liquid discharge head 26 is filled with ink, test printing may be performed.

As described above, according to the exemplary embodiment, the switching valve 36 can be switched so that the fluid emitted from the nozzles N by the cleaning apparatus 40 suppling fluid, such as a cleaning liquid, to the liquid discharge head 26 is emitted from the outlet opening 38 without using the pump 35 or the waste liquid tank 34 provided in the liquid discharge apparatus 10. Therefore, without having to detach the liquid discharge head 26 from the liquid discharge apparatus 10, the cleaning apparatus 40 can be used to vigorously clean the liquid discharge head 26 with a large amount of a cleaning liquid and also to efficiently clean the liquid discharge head 26 by circulating a small amount of a cleaning liquid. Hence, the cleaning time needed for the liquid discharge head 26 can be reduced in comparison with the case where the liquid discharge head 26 is detached from the liquid discharge apparatus 10 before cleaning. Furthermore, since there is no need to use either one of the pump 35 and the waste liquid tank 34 that are provided in the liquid discharge apparatus 10, vigorous cleaning is possible without having to increase the sizes or capacities of the pump 35 and the waste liquid tank 34. Thus, the liquid discharge apparatus 10 itself can be reduced in size. Thus, according to the exemplary embodiment, it is possible to reduce the cleaning time needed for the liquid discharge head 26 and, at the same time, reduce the size of the liquid discharge apparatus 10.

Furthermore, in the cleaning process illustrated in FIG. 6, the non-circulatory cleaning step (step S102) with the second cleaning liquid is followed by the circulatory cleaning step (step S103) with the first cleaning liquid. Therefore, because stain or the like can be removed from interiors of the liquid discharge head 26 in the non-circulatory cleaning step with the second cleaning liquid before the circulatory cleaning step with the first cleaning liquid is performed, the cleaning effect of the circulatory cleaning can be improved. Furthermore, it is possible to heat only the first cleaning liquid in the first tank T1 which is for use for the circulatory cleaning, so that heat used for the heating can be used for cleaning without wasting the heat.

Incidentally, in the cleaning process illustrated in FIG. 6, the circulatory cleaning step (step S103) may be performed prior to the non-circulatory cleaning step (step S102). Concretely, first, in the circulatory cleaning step, the first cleaning liquid from the first tank T1 is circulated through the liquid discharge head 26 to clean the liquid discharge head 26. Then, in the non-circulatory cleaning step, the second cleaning liquid from the second tank T2 is passed through the liquid discharge head 26 to clean the liquid discharge head 26. Therefore, in the non-circulatory cleaning step, a cleaning liquid different from the cleaning liquid used for circulatory cleaning can be passed through the liquid discharge head 26. Hence, it is possible, for example, to use a cleaning liquid having high cleaning effect in circulatory cleaning and a cleaning liquid that is high in filling capability (wetting property) in non-circulatory cleaning, so that it is possible to increase the cleaning effect of circulatory cleaning and, at the same time, increase the ink filling capability exhibited after non-circulatory cleaning. Since the ink filling capability of the cleaning liquid can be increased, for example, by changing the amount of a surface-active agent or changing the viscosity, the second cleaning liquid used in the non-circulatory cleaning may be a cleaning liquid that can increase the ink filling capability.

Incidentally, history of the cleaning of the liquid discharge head 26 (e.g., dates and times of cleaning, cleaning process contents, cleaning durations, etc.) may be stored in, for example, the storage unit 203, and, on the basis of the cleaning history, the next cleaning of the liquid discharge head 26 may be performed. For example, when the date and time of the previous cleaning is earlier than a predetermined date and time, the duration of the next cleaning can be made longer than the duration of the previous cleaning.

Modifications

The exemplary embodiments illustrated above can be modified in various manners. Concrete modifications may be examples of Modes 1 to 29 mentioned above or may also be examples described below. Two or more examples and the like selected from these examples can be combined as appropriate as long as they contradict each other.

(1) Although the foregoing exemplary embodiments have been described in conjunction with serial head type liquid discharge apparatuses in which the carriage 24 on which the liquid discharge head 26 is mounted is moved back and forth along the X direction, the invention is also applicable to line head type liquid discharge apparatuses in which the liquid discharge heads 26 are arranged over the entire width of the medium 12.

(2) Although the foregoing exemplary embodiments have been described in conjunction with the piezoelectric type liquid discharge head 26 that employ piezoelectric elements that apply mechanical vibration to the pressure chambers, a thermal type liquid discharge head that employs heating elements that thermally produce bubbles inside the pressure chambers can also be adopted in the invention.

(3) The liquid discharge apparatuses illustrated as examples in conjunction with the foregoing exemplary embodiments may be adopted in not only appliances dedicated to printing but also various other appliances such as facsimile apparatuses and copying machines. However, the use of the liquid discharge apparatus of the invention is not limited to printing. For example, a liquid discharge apparatus that discharges solutions of color materials is used as a production apparatus that forms color filters for liquid crystal display apparatuses. Furthermore, a liquid discharge apparatus that discharges solutions of electroconductive materials is used as a production apparatus that forms wirings, electrodes, etc., of wire substrates.

CROSS-REFERENCE TO RELATED APPLICATIONS

This application claims priority to Japanese Patent Application No. 2016-203493 filed on Oct. 17, 2016 and Japanese Patent Application No. 2016-203494 filed on Oct. 17, 2016. The entire disclosures of Japanese Patent Application Nos. 2016-203493 and 2016-203494 are hereby incorporated herein by reference.

What is claimed is:

1. A liquid discharge apparatus comprising:

a casing;

a liquid discharge head that includes a nozzle for discharging a liquid supplied from a liquid supply source; and an outlet opening for emitting a fluid emitted from the nozzle to an outside of the casing; and a waste liquid tank provided in the casing for accommodating the fluid emitted from the nozzle, wherein the liquid discharge apparatus is configured to emit the fluid emitted from the nozzle to the outside of the casing from the outlet opening with bypassing the waste liquid tank.

2. The liquid discharge apparatus according to claim 1, further comprising a switching valve that is provided in an intermediate portion of a waste liquid flow path extending from the nozzle to the waste liquid tank, the switching valve being in communication with the outlet opening and configured to switch between a state that causes the fluid emitted from the nozzle to be emitted into the waste liquid tank and a state that causes the fluid emitted from the nozzle to be emitted through the outlet opening.

3. The liquid discharge apparatus according to claim 2, wherein a diameter of an outlet flow path that provides communication between the outlet opening and the switching valve is larger than at least a diameter of the waste liquid flow path.

4. The liquid discharge apparatus according to claim 2, further comprising a communicator unit configured to communicate with the liquid supply source wirelessly or by wire, wherein, based on a result of communication of the communicator unit, the switching valve is configured to switch between a state that causes the fluid emitted from the nozzle to be emitted into the waste liquid tank and a state that causes the fluid emitted from the nozzle to be emitted through the outlet opening.

5. The liquid discharge apparatus according to claim 2, wherein the switching valve is capable of being atmospherically opened.

6. The liquid discharge apparatus according to claim 1, further comprising:

a waste liquid tank provided in the casing; and a switching valve that is provided in an intermediate portion of a waste liquid flow path extending from the nozzle to the waste liquid tank, the switching valve being in communication with the outlet opening and configured to switch between a state that causes the fluid emitted from the nozzle to be emitted into the waste liquid tank and a state that causes the fluid emitted from the nozzle to be emitted through the outlet opening.

7. The liquid discharge apparatus according to claim 1, further comprising an attaching portion configured to allow a connecting portion of the liquid supply source for supplying the liquid to the liquid discharge head and a connecting portion for supplying a fluid for cleaning to the liquid discharge head to be interchangeably attached to the attaching portion.

8. The liquid discharge apparatus according to claim 1, further comprising a pump for moving the fluid emitted from the nozzle to the outlet opening.

9. The liquid discharge apparatus according to claim 1, wherein the pump is operated so as to suck the nozzle, and wherein the pump is operated so that suction force of the pump is greater when the fluid emitted from the nozzle is sucked than when the liquid supplied from the liquid supply source is sucked from the nozzle.

10. The liquid discharge apparatus according to claim 1, further comprising a cover that covers the outlet opening.

11. A cleaning apparatus that cleans the liquid discharge head of the liquid discharge apparatus according to claim 1, the cleaning apparatus comprising:

a supply flow path for supplying a fluid for cleaning to the liquid discharge head attached to the liquid discharge apparatus; and a recovery flow path for recovering the fluid emitted from the outlet opening.

12. The cleaning apparatus according to claim 11, further comprising a connecting portion for connecting the supply flow path to the liquid discharge head, wherein the connecting portion is capable of being attached, interchangeably with a connecting portion of the liquid supply source, to an attaching portion provided in the liquid discharge apparatus to which the connecting portion of the liquid supply source is attached so as to be connected to the liquid discharge head, at the same site in the attaching portion as the connecting portion of the liquid supply source is attached.

13. The cleaning apparatus according to claim 11, further comprising a pump that is provided in an intermediate portion of the recovery flow path and that is configured to move the fluid emitted from the nozzle toward the recovery flow path via the outlet opening.

14. The cleaning apparatus according to claim 11, further comprising a circulation flow path for moving the fluid from the recovery flow path to the supply flow path.

15. The cleaning apparatus according to claim 11, further comprising as tanks for storing the fluid at least a first tank provided on the circulation flow path and a second tank provided on the supply flow path.

16. The cleaning apparatus according to claim 11, further comprising a filter provided in an intermediate portion of the supply flow path.

17. The cleaning apparatus according to claim 11, wherein any one of Condition 1 to Condition 3 mentioned below is satisfied:

Condition 1 the cleaning apparatus further comprises an atmospherically openable valve provided in an intermediate portion of the supply flow path and capable of being switched to be atmospherically open;

Condition 2 the cleaning apparatus further comprises an open/close valve provided in an intermediate portion of the supply flow path; and Condition 3 the cleaning apparatus further comprises a negative pressure generating mechanism provided in an intermediate portion of the supply flow path.

18. A cleaning method for the liquid discharge head in the liquid discharge apparatus according to claim 1, the cleaning method comprising:

a first step of emitting a fluid from the nozzle of the liquid discharge head by supplying a fluid for cleaning to the liquid discharge head attached to the liquid discharge apparatus; and a second step of recovering the fluid emitted from the nozzle via the outlet opening of the liquid discharge apparatus.

19. The cleaning method according to claim 18, further comprising a third step of supplying the fluid recovered in the second step to the liquid discharge apparatus and reemitting a fluid from the nozzle of the liquid discharge head.

20. The cleaning method according to claim 19, further comprising:

employing a cleaning apparatus that includes a supply flow path that supplies the fluid for cleaning to the liquid discharge head, a recovery flow path for recovering the fluid emitted from the outlet opening, a circulation flow path for moving the fluid from the recovery flow path to the supply flow path, and, as tanks for storing the fluid, at least a first tank provided on the circulation flow path and a second tank provided on the supply flow path;

a circulatory cleaning step of cleaning the liquid discharge head by circulating the fluid stored in the first tank to the liquid discharge head by the first step, the second step, and the third step; and a non-circulatory cleaning step of cleaning the liquid discharge head with the fluid stored in the second tank by the first step and the second step, without circulating the fluid to the liquid discharge head.

21. The cleaning method according to claim 20, wherein the circulatory cleaning step is performed after the non-circulatory cleaning step.

22. The cleaning method according to claim 20, wherein the non-circulatory cleaning step is performed after the circulatory cleaning step.

23. The cleaning method according to claim 18, wherein after the liquid discharge head is cleaned, a fluid in the outlet opening of the liquid discharge apparatus is emitted by using air.

24. The cleaning method according to claim 18, wherein a cleaning history of the liquid discharge head is stored in a storage unit and, based on the cleaning history, subsequent cleaning of the liquid discharge head is performed.

* * * * *